US009608353B1

(12) United States Patent
Ang et al.

(10) Patent No.: US 9,608,353 B1
(45) Date of Patent: Mar. 28, 2017

(54) CONDUCTIVE TERMINAL AND ELECTRICAL CONNECTOR ASSEMBLY

(71) Applicant: Molex, LLC, Lisle, IL (US)

(72) Inventors: Lay Khim Ang, Singapore (SG); Kian Heng Lim, Singapore (SG)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 15/280,602

(22) Filed: Sep. 29, 2016

(30) Foreign Application Priority Data

Oct. 12, 2015 (CN) ..... 2015 1 0659101

(51) Int. Cl.

| | |
|---|---|
| ***H01R 11/22*** | (2006.01) |
| ***H01R 13/24*** | (2006.01) |
| ***H01R 24/62*** | (2011.01) |
| ***H01R 13/436*** | (2006.01) |
| *H01R 103/00* | (2006.01) |

(52) U.S. Cl.
CPC ..... *H01R 13/245* (2013.01); *H01R 13/4367* (2013.01); *H01R 24/62* (2013.01); *H01R 2103/00* (2013.01)

(58) Field of Classification Search
CPC ..... H01R 11/22; H01R 13/113; H01R 13/15; H01R 13/187; H01R 13/111
USPC ..... 439/849, 852, 847, 843, 948, 442, 845, 439/848, 381
See application file for complete search history.

(56) References Cited

U.S. PATENT DOCUMENTS

| | | | | |
|---|---|---|---|---|
| 3,742,430 A | | 6/1973 | Cairns et al. | |
| 4,764,129 A | | 8/1988 | Jones et al. | |
| 5,183,418 A | | 2/1993 | Yamanashi et al. | |
| 5,281,175 A | * | 1/1994 | Chupak | H01R 13/113 439/839 |
| 5,496,190 A | | 3/1996 | Ittah et al. | |
| 5,660,569 A | * | 8/1997 | Yamada | H01R 13/115 428/209 |
| 5,810,627 A | * | 9/1998 | Gierut | H01R 13/187 439/843 |
| 5,897,405 A | * | 4/1999 | Endo | H01R 13/11 439/852 |
| 6,024,612 A | * | 2/2000 | Myer | H01R 13/113 439/744 |

(Continued)

FOREIGN PATENT DOCUMENTS

GB 886251 1/1962

*Primary Examiner* — Phuongchi T Nguyen
(74) *Attorney, Agent, or Firm* — James A. O'Malley

(57) ABSTRACT

A conductive terminal is provided which includes a base unit, two elastic contact pieces, a tail unit and two contact plates. The base unit includes a bottom plate extending along a front-rear direction and two side plates integrally extending upwardly from a left and right sides of the bottom plate respectively. The two elastic contact pieces are arranged side by side, each elastic contact piece comprises a connecting portion bent upwardly from a front end of the bottom plate, an arm portion extending rearwardly from the connecting portion, positioned above the bottom plate and spaced apart from the bottom plate, and a first contact portion positioned at a rear end of the arm portion. The tail unit is connected to a rear end of the bottom plate. The two contact plates are respectively bent from two upper edges of two front ends of the two side plates toward each other.

15 Claims, 25 Drawing Sheets

(56) References Cited

U.S. PATENT DOCUMENTS

| | | | | |
|---|---|---|---|---|
| 6,116,970 | A * | 9/2000 | Yamamoto | H01R 13/113 439/852 |
| 6,139,376 | A * | 10/2000 | Ooya | H01R 13/187 439/442 |
| 7,153,173 | B2 | 12/2006 | Harasawa et al. | |
| 8,388,388 | B2 * | 3/2013 | Suzuki | H01R 13/113 439/752.5 |
| 2012/0057824 | A1 | 3/2012 | Katoh | |

* cited by examiner

CONDUCTIVE TERMINAL AND ELECTRICAL CONNECTOR ASSEMBLY

RELATED APPLICATIONS

This application claims priority to Chinese Application No. 201510659101.4, filed Oct. 12, 2015, which is incorporated herein by reference in its entirety.

TECHNICAL FIELD

The present disclosure relates to a conductive terminal and an electrical connector assembly, and more specifically relates to a conductive terminal and an electrical connector assembly in which the two conductive terminals may be mated with each other to form four contacting regions.

BACKGROUND ART

In a known matable male connector and female connector assembly, a conductive terminal provided in a male connector and a conductive terminal provided in a female connector each have a contact elastic piece and each are used to connect a cable, for example, as disclosed in United Kingdom patent application publication No. GB886,251A, when the male connector and the female connector are mated with each other, the conductive terminal of the male connector and the conductive terminal of the female connector contact with each other via the two contact elastic pieces, there is only one contacting region between the two mated conductive terminals, but both of the two contact elastic pieces of the two conductive terminals have elasticity, therefore the two contact elastic pieces are easily affected by an improper external force, such as vibration, pulling from the cable and the like, the two contact elastic pieces of the two conductive terminals cannot stably contact with each other. Moreover, after long-term use, the contact elastic piece may generate elastic fatigue, which also easily results in the contact between the two contact elastic pieces of the two conductive terminals not stable.

Similarly, for example, an electrical connector is disclosed in U.S. Pat. No. 7,153,173 (corresponding to Chinese patent application No. CN201110212282.8 and corresponding to Taiwanese patent TW90129848), which comprises a conductive terminal having two contacting points and two elastic portions and two abutting-pressing plates respectively extending to above two top surfaces of the two elastic portions of the conductive terminal. Still for example, an electrical connector is disclosed in U.S. Pat. No. 3,742,430, which comprises a bottom plate, a conductive terminal extending from a front edge of the bottom plate, and two side plates extending respectively from two sides of the bottom plate, each side plate has a protruding portion extending to a front section of the conductive terminal and a guide portion extending forwardly from the protruding portion.

However, each conductive terminal of the above two electrical connector is used to electrically connect a wire on a circuit board, but is not used to mate with another conductive terminal, and each conductive terminal of the two electrical connectors only has one contacting region or two contacting regions, thereby also easily resulting in electrical connection of the conductive terminal less stable.

SUMMARY OF THE INVENTION

Therefore, the present disclosure provides a conductive terminal which can resolve the previous problem.

Therefore, the present disclosure further provides an electrical connector assembly which can resolve the previous problem.

Therefore, in some embodiments, a conductive terminal of the present disclosure comprises a base unit, two elastic contact pieces, a tail unit and two contact plates. The base unit comprises a bottom plate extending along a front-rear direction and two side plates integrally extending upwardly from a left side and a right side of the bottom plate respectively. The two elastic contact pieces are arranged side by side, each elastic contact piece comprises a connecting portion bent upwardly from a front end of the bottom plate, an arm portion extending rearwardly from the connecting portion, positioned above the bottom plate and spaced apart from the bottom plate, and a first contact portion positioned at a rear end of the arm portion. The tail unit is connected to a rear end of the bottom plate. The two contact plates are respectively bent from two upper edges of two front ends of the two side plates toward each other, each contact plate has a second contact portion and a guide portion positioned in front of the second contact portion, the second contact portion is positioned above the arm portion of the corresponding the elastic contact piece, the guide portion extends forwardly and downwardly and being positioned above the connecting portion, The two first contact portions of the two elastic contact pieces extend upwardly respectively from two rear ends of the two contact plates and are respectively higher than the two second contact portions.

In some embodiments, the two side plates of the base unit respectively at least partially cover two side gaps between two side edges of the bottom plate and two side edges of the two arm portions of the two elastic contact pieces.

In some embodiments, each elastic contact piece further comprises an extending portion, the extending portion bent from a rear end of the first contact portion and extending rearwardly and obliquely, and a distal end of the extending portion enters into between the two side plates and is not higher than two upper edges of the two side plates.

In some embodiments, the conductive terminal further comprises two protect plates respectively bent from two upper edges of two rear ends of the two side plates toward each other, the two protect plates respectively are positioned behind the two extending portions of the two elastic contact pieces.

In some embodiments, the bottom plate comprises a plate portion and two wing portions respectively extending from two sides of a front end of the plate portion toward two opposite directions, and the two wing portions respectively are positioned in front of the two side plates.

In some embodiments, the tail unit along the front-rear direction comprises a positioning portion connected to the plate portion, a conductor fixing portion connected to the positioning portion and used to clamp and fix a part of a conductor of a cable without an insulating covering and an insulating covering fixing portion connected to the conductor fixing portion and used to clamp and fix a part of the cable with the insulating covering.

In some embodiments, an electrical connector assembly of the present disclosure comprises a first connector and a second connector mated with the first connector. The first connector comprises a first insulating housing and a plurality of conductive terminals provided in the first insulating housing, the second connector comprises a second insulating housing and a plurality of conductive terminals provided in the second insulating housing. Each conductive terminal of the first connector and the second connector has a base unit, two elastic contact pieces, a tail unit and two contact plates.

The base unit comprises a bottom plate extending along a front-rear direction and two side plates integrally extending upwardly from a left side and a right side of the bottom plate respectively. The two elastic contact pieces are arranged side by side, each elastic contact piece has a connecting portion bent upwardly from a front end of the bottom plate, an arm portion extending rearwardly from the connecting portion, positioned above the bottom plate and spaced apart from the bottom plate, and a first contact portion positioned at a rear end of the arm portion. The tail unit is connected to a rear end of the bottom plate. The two contact plates are respectively bent from two upper edges of two front ends of the two side plates toward each other, each contact plate has a second contact portion and a guide portion positioned in front of the second contact portion, the second contact portion is positioned above the arm portion of the corresponding the elastic contact piece, the guide portion extends forwardly and downwardly and being positioned above the connecting portion. The two first contact portions of the two elastic contact pieces extend upwardly respectively from two rear ends of the two contact plates and are respectively higher than the two second contact portions.

The plurality of conductive terminals of the first connector are used to respectively mate with the plurality of conductive terminals of the second connector, and in every two mated conductive terminals between the first connector and the second connector, the two first contact portions of one conductive terminal respectively contact the two second contact portions of the other conductive terminal and the two first contact portions of the other conductive terminal respectively contact the two second contact portions of the one conductive terminal, so that four contacting regions are formed between every two mated conductive terminals.

In some embodiments, in each conductive terminal, the two side plates of the base unit respectively at least partially cover two side gaps between two side edges of the bottom plate and two side edges of the two arm portions of the two elastic contact pieces.

In some embodiments, in each conductive terminal, each elastic contact piece further has an extending portion, the extending portion bent from a rear end of the first contact portion and extending rearwardly and obliquely, and a distal end of the extending portion enters into between the two side plates and is not higher than two upper edges of the two side plates.

In some embodiments, in each conductive terminal, the conductive terminal further has two protect plates respectively bent from two upper edges of two rear ends of the two side plates toward each other, the two protect plates respectively are positioned behind the two extending portions of the two elastic contact pieces.

In some embodiments, the first insulating housing has a first mating portion, a first mounting portion integrally connected with the first mating portion and a plurality of terminal grooves each penetrating the first mating portion and the first mounting portion; the second insulating housing has a second mating portion, a second mounting portion integrally connected with the second mating portion and a plurality of terminal grooves each penetrating the second mating portion and the second mounting portion; the second mating portion is used to mate with the first mating portion; the plurality of terminal grooves of the first insulating housing respectively receive the plurality of conductive terminals of the first connector; the plurality of terminal grooves of the second insulating housing respectively receive the plurality of conductive terminals of the second connector.

In some embodiments, in each conductive terminal, the bottom plate has a plate portion and two wing portions respectively extending from two sides of a front end of the plate portion toward two opposite directions, and the two wing portions respectively are positioned in front of the two side plates; each terminal groove is provided with two side groove portions respectively seizing two wing portions of the corresponding conductive terminal therein.

In some embodiments, in each conductive terminal, the tail unit along the front-rear direction has a positioning portion connected to the plate portion, a conductor fixing portion connected to the positioning portion and used to clamp and fix a part of a conductor of a cable without an insulating covering and an insulating covering fixing portion connected to the conductor fixing portion and used to clamp and fix a part of the cable with the insulating covering.

In some embodiments, each terminal groove is further provided with an elastic finger portion and a stopping block positioned in front of the elastic finger portion and spaced apart from the elastic finger portion therein, the elastic finger portion is formed with a step portion facing the front, the stopping block is formed with a stopping protrusion facing the rear; the positioning portion of each conductive terminal forms an annular shape and has two piece bodies facing each other, spaced apart from each other and higher than the contact plate, and two front edges of the two piece bodies abut against a rear end surface of the stopping block, two rear edges of the two piece bodies abut against the step portion of the elastic finger portion, the positioning portion is sheathed onto the stopping block, so that the positioning portion is positioned between the elastic finger portion and the stopping block and in turn the conductive terminal is positioned in the terminal groove.

In some embodiments, the first connector further comprises a first terminal holding member, the second connector further comprises a second terminal holding member; the first terminal holding member is engaged with the first mounting portion and has a plurality of first positioning pieces respectively entering into the plurality of terminal grooves of the first insulating housing, a front end of each first positioning piece is positioned on two rear ends of the two piece bodies of the positioning portion of the corresponding conductive terminal of the first connector; the second terminal holding member is engaged with the second mounting portion and has a plurality of second positioning pieces respectively entering into the plurality of terminal grooves of the second insulating housing, a front end of each second positioning piece is positioned on two rear ends of the two piece bodies of the positioning portion of the corresponding conductive terminal of the second connector.

The beneficial effects of the present disclosure lie in that: the conductive terminal of the first connector and the conductive terminal of the second connector are identical in structure and dimension, manufacturing cost may be saved; in every two mated conductive terminal, the two first contact portions of one conductive terminal respectively contact the two second contact portions of the other conductive terminal and the two first contact portions of the other conductive terminal respectively contact the two second contact portions of the one conductive terminal, so that four contacting regions are formed between every two mated conductive terminals, which provides a more stable and more reliable electrical connection and can promote performance and stability under long-term use; the structural design of the conductive terminal may prevent hooking and entangling between one conductive terminal and another conductive terminal or between the conductive terminal and the cable during manufacturing, and in turn prevent the conductive terminal from being damaged; and, that the two keys are respectively engaged with the two keys grooves may prevent the first connector and the second connector from being improperly inserted.

BRIEF DESCRIPTION OF THE DRAWINGS

The other features and effects of the present disclosure will be apparent through detailed description of embodiments with referring to the Figures, and in which.

DETAILED DESCRIPTION OF THE PREFERRED EMBODIMENTS

Figure 1:
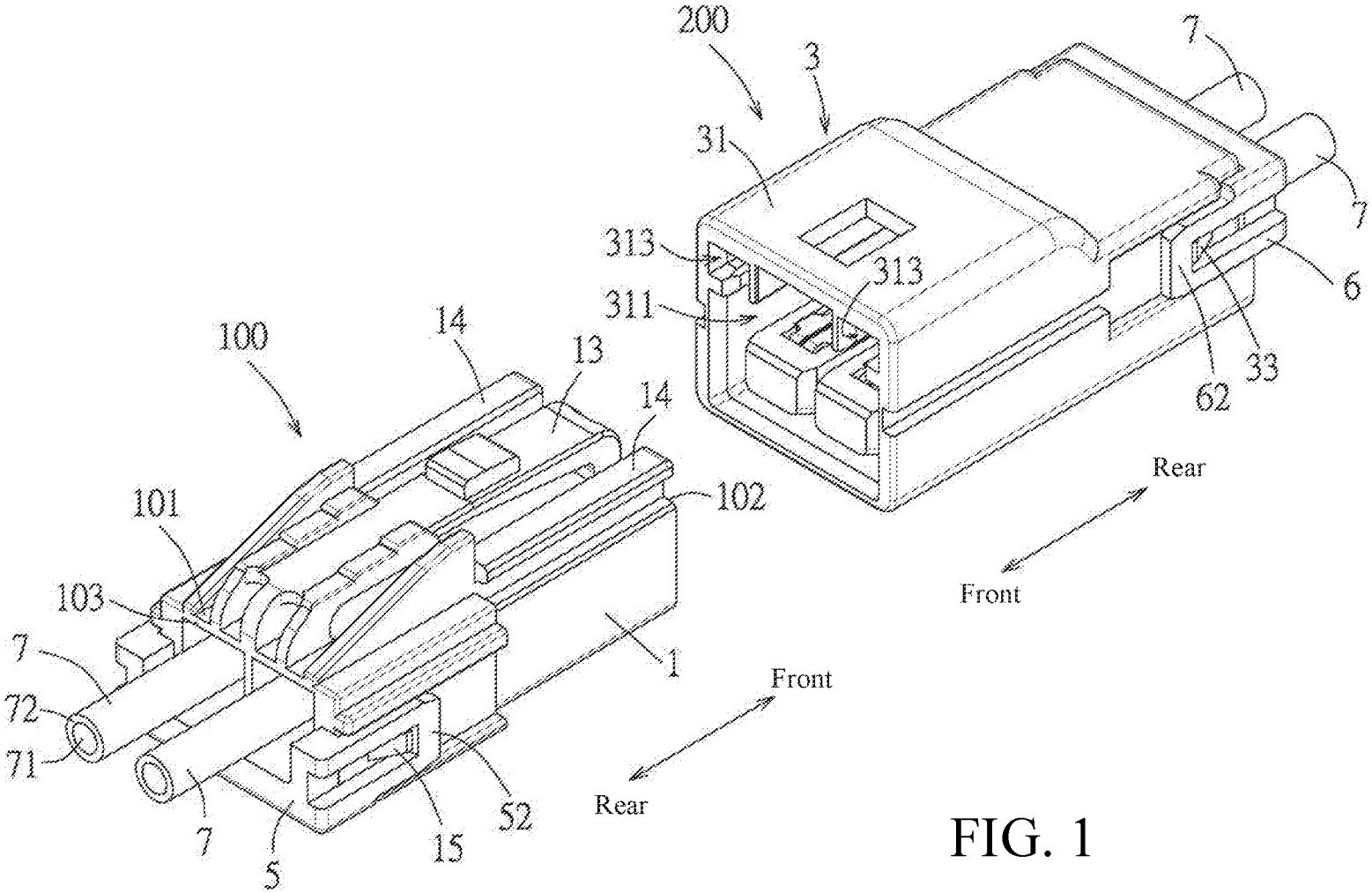
FIG. 1 is an exploded perspective view illustrating an embodiment of an electrical connector assembly of the present disclosure with a first connector and a second connector unmated with each other.

Before the present disclosure is described in detail, it should be noted that similar element is indicated by the same reference numeral in the following description.

Figure 2:
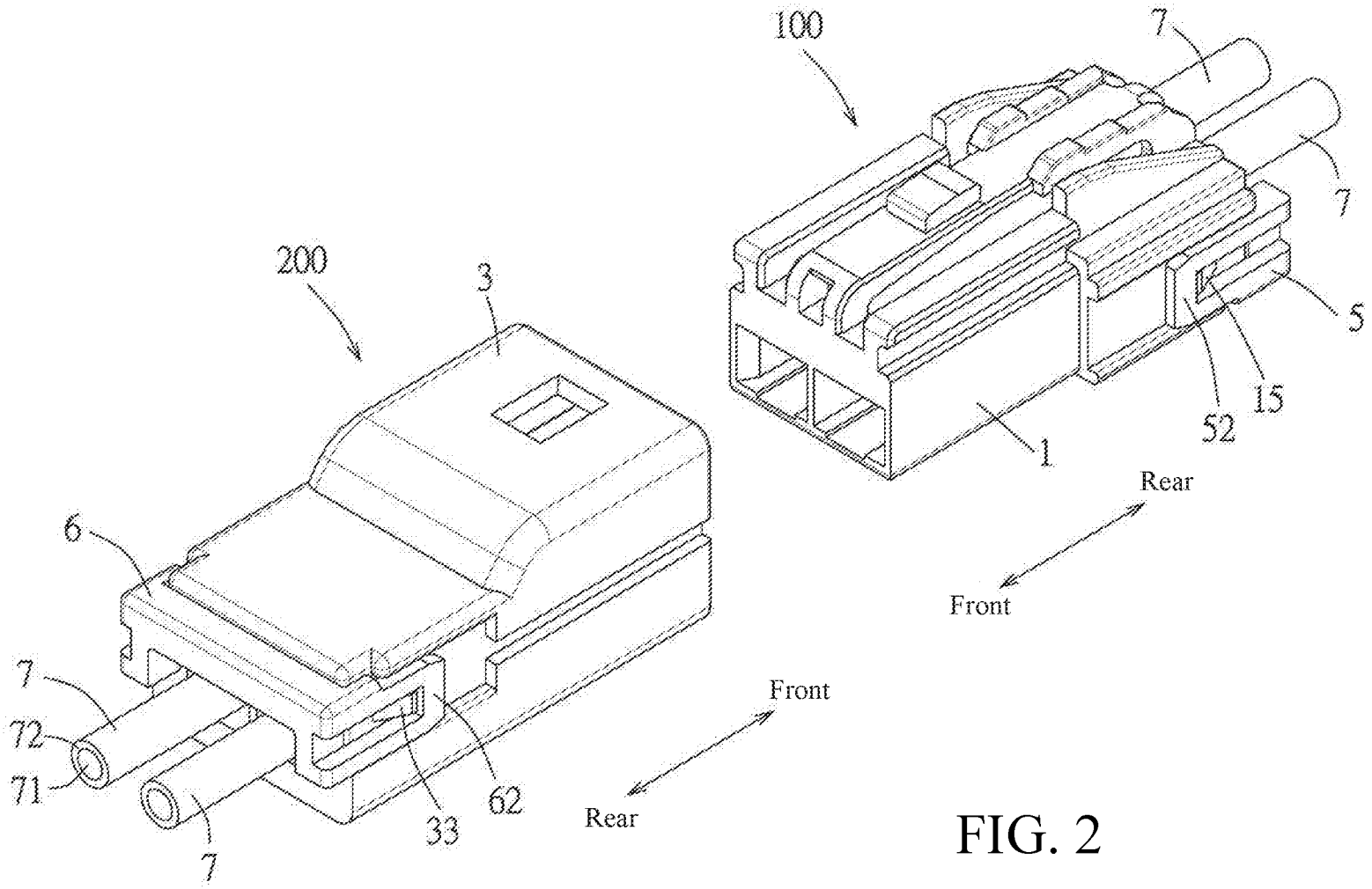
FIG. 2 is a view of FIG. 1 viewed from another angle.
Figure 3:
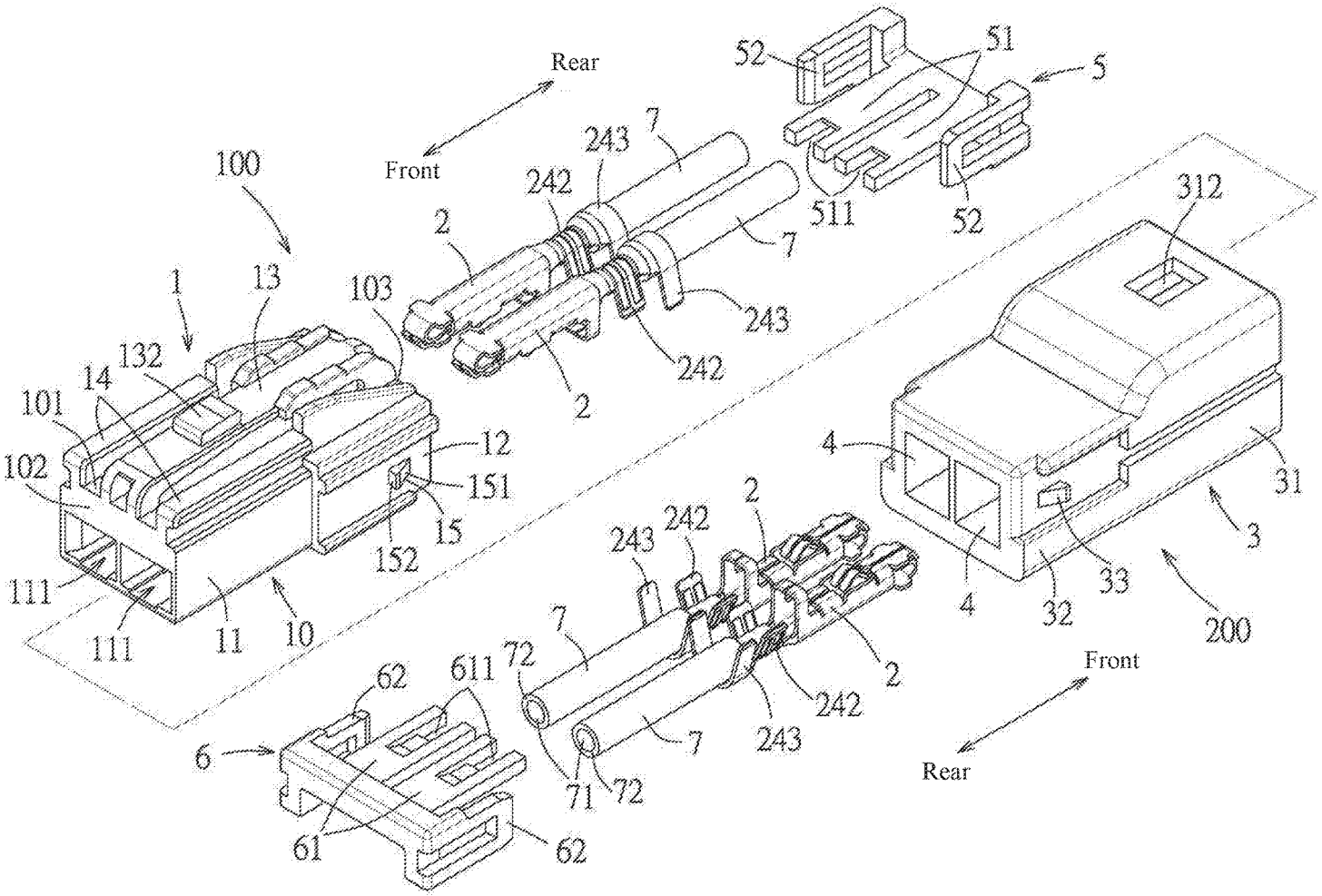
FIG. 3 is an exploded perspective view illustrating components of the first connector and the second connector of the embodiment.

Referring to FIG. 1, FIG. 2 and FIG. 3, an embodiment of an electrical connector assembly of the present disclosure comprises: a first connector 100 and a second connector 200 which may be mated with the first connector 100. The first connector 100 comprises a first insulating housing 1, a plurality of conductive terminals 2 provided in the first insulating housing 1 and a first terminal holding member 5. The second connector 200 comprises a second insulating housing 3, a plurality of conductive terminals 2 provided in the second insulating housing 3 and a second terminal holding member 6. In the embodiment, the conductive terminal 2 of the first connector 100 and the conductive terminal 2 of the second connector 200 are identical.

Figure 4:
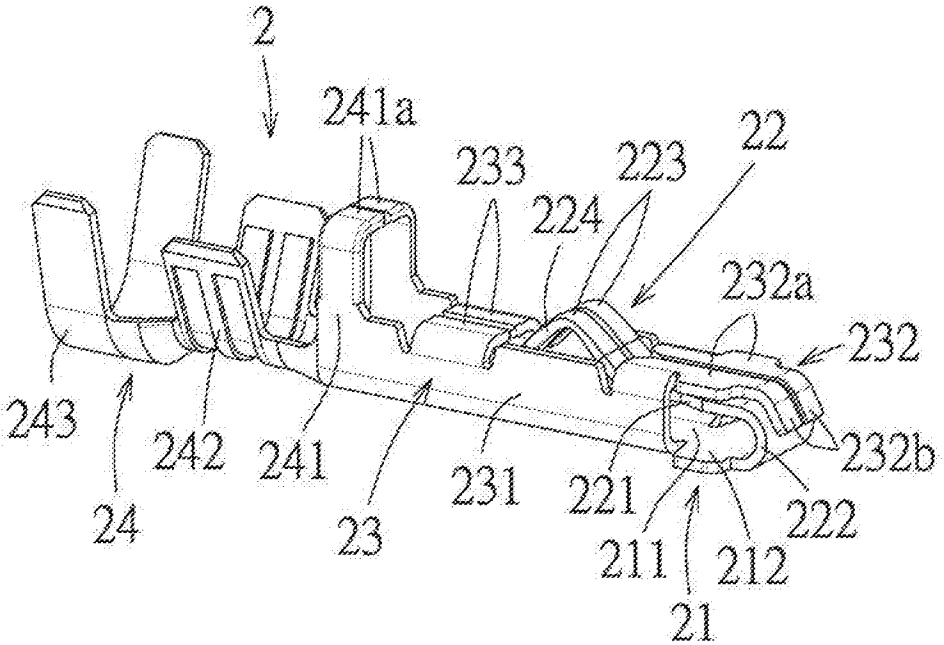
FIG. 4 is a perspective view illustrating a conductive terminal of the embodiment.

Referring to FIG. 3 and FIG. 4, each conductive terminal 2 of the first connector 100 and the second connector 200 has a base unit 23, two elastic contact pieces 22, two contact plates 232, two protect plates 233 and a tail unit 24. The base unit 23 has a bottom plate 21 and two side plates 231. The bottom plate 21 extends along a front-rear direction, and has a plate portion 211 and two wing portions 212 respectively extending from two sides of a front end of the plate portion 211 toward two opposite directions, the two side plates 231 integrally extend upwardly from a left side and a right side of the plate portion 211 of the bottom plate 21 respectively. The two elastic contact pieces 22 are arranged side by side, specifically, each elastic contact piece 22 has a connecting portion 222 bent upwardly from a front end of the bottom plate 21 and having a curved-shape, an arm portion 221 extending rearwardly from the connecting portion 222, positioned above the bottom plate 21 and spaced apart from the bottom plate 21, a first contact portion 223 positioned at a rear end of the arm portion 221, and an extending portion 224 bent from a rear end of the first contact portion 223 and extending obliquely and downwardly toward the rear. The two contact plates 232 are bent respectively from two upper edges of two front ends of the two side plates 231 toward each other, and the two protect plates 233 are bent respectively from two upper edges of two rear ends of the two side plates 231 toward each other. Herein, the two side plates 231 at least partially cover two side gaps between the bottom plate 21 and the two arm portions 221 respectively, and the two side plates 231 are positioned respectively behind the two wing portions 212. Each contact plate 232 has a second contact portion 232*a* and a guide portion 232*b* positioned in front of the second contact portion 232*a*, the second contact portion 232*a* is positioned above the arm portion 221 of the corresponding elastic contact piece 22 so as to protect the arm portion 221, and the second contact portion 232*a* can be further used for electrical connection, the guide portion 232*b* extends obliquely and downwardly toward the front and substantially covers an upper half part region of the corresponding connecting portion 222 so as to protect the corresponding connecting portion 222. The two protect plates 233 are respectively positioned behind the two extending portions 224. It should be noted that, the two first contact portions 223 respectively extend upwardly from two rear ends of the two contact plates 232 and respectively are higher than the two second contact portions 232*a*, and two distal ends of the two extending portions 224 enter into between the two side plates 231 and are not higher than the two upper edges of the two side plates 231. The tail unit 24 is connected to a rear end of the bottom plate 21, and the tail unit 24, along the front-rear direction, has a positioning portion 241 connected to the plate portion 211, a conductor fixing portion 242 positioned behind the positioning portion 241 and used to clamp and fix a part of the conductor 71 of a cable 7 without an insulating covering 72, and an insulating covering fixing portion 243 positioned behind the conductor fixing portion 242 and used to clamp and fix a part of the cable 7 with the insulating covering 72. By that the two side plate portions 231 at least partially cover the two side gaps between the two side edges of the plate portion 211 and the two side edges of the two arm portions 221 respectively, by that the two distal ends of the two extending portion 224 enter into between the two side plates 231 and by that the two protect plates 233 cover a space behind the two extending portions 224, it may prevent hooking and entangling between one conductive terminal 2 and another conductive terminal 2 or between the conductive terminal 2 and the cable 7 during manufacturing, and in turn prevent the conductive terminal 2 from being damaged. In an embodiment, these constituent components of the conductive terminal 2 are integrally formed from a metal sheet.

It should be noted that, in the embodiment, the front-rear direction of the first connector 100 and the front-rear direction of the second connector 200 each are defined as the front at a mating side between the first connector 100 and the second connector 200 and the rear at a side connected to the corresponding cable 7, therefore the front-rear direction of the first connector 100 and the front-rear direction of the second connector 200 are respectively indicated by two different arrows in FIG. 1 to FIG. 3.

Figure 5:
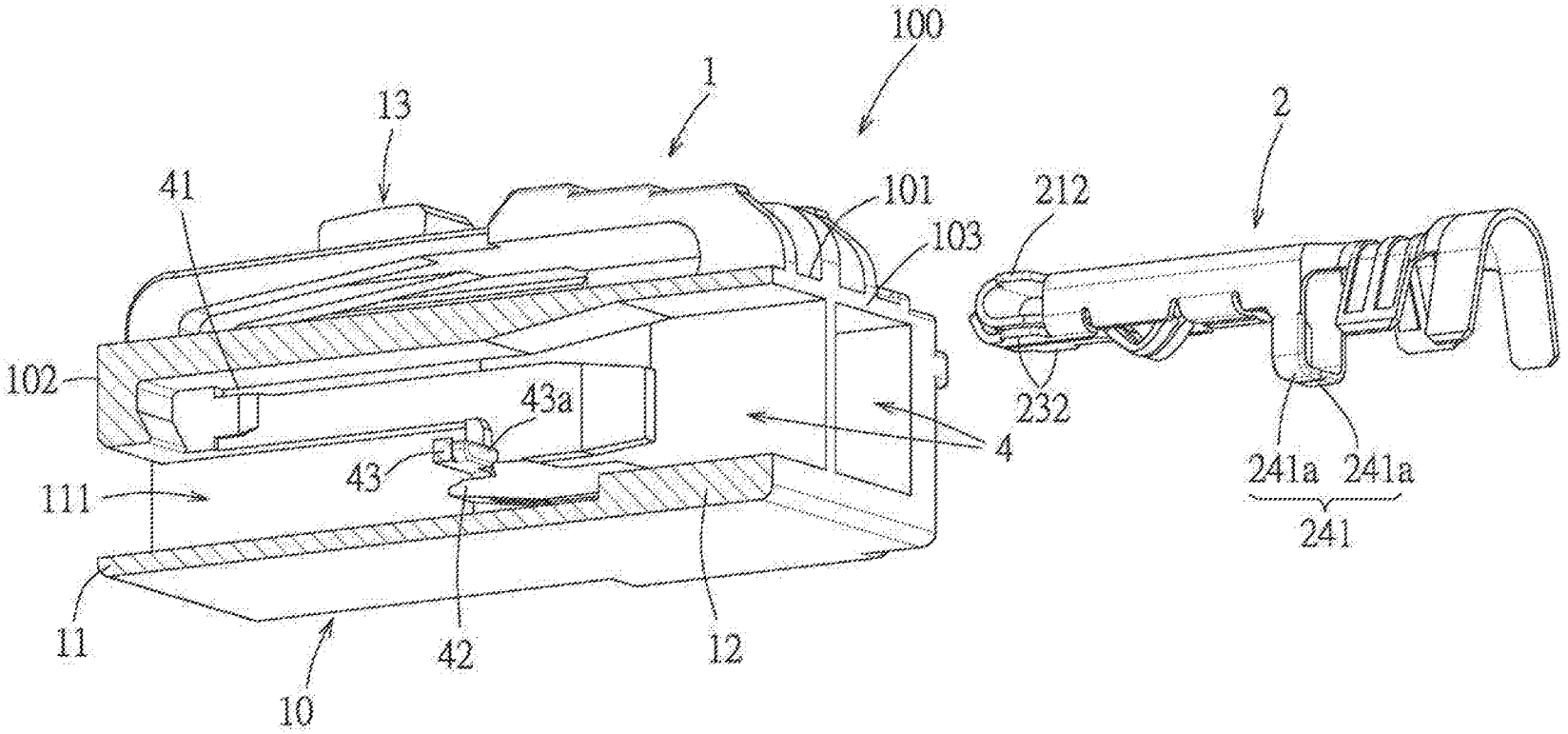
FIG. 5 is an exploded perspective view partially sectioned and illustrating a corresponding relationship between a terminal groove and the conductive terminal of the first connector of the embodiment in structure.
Figure 6:
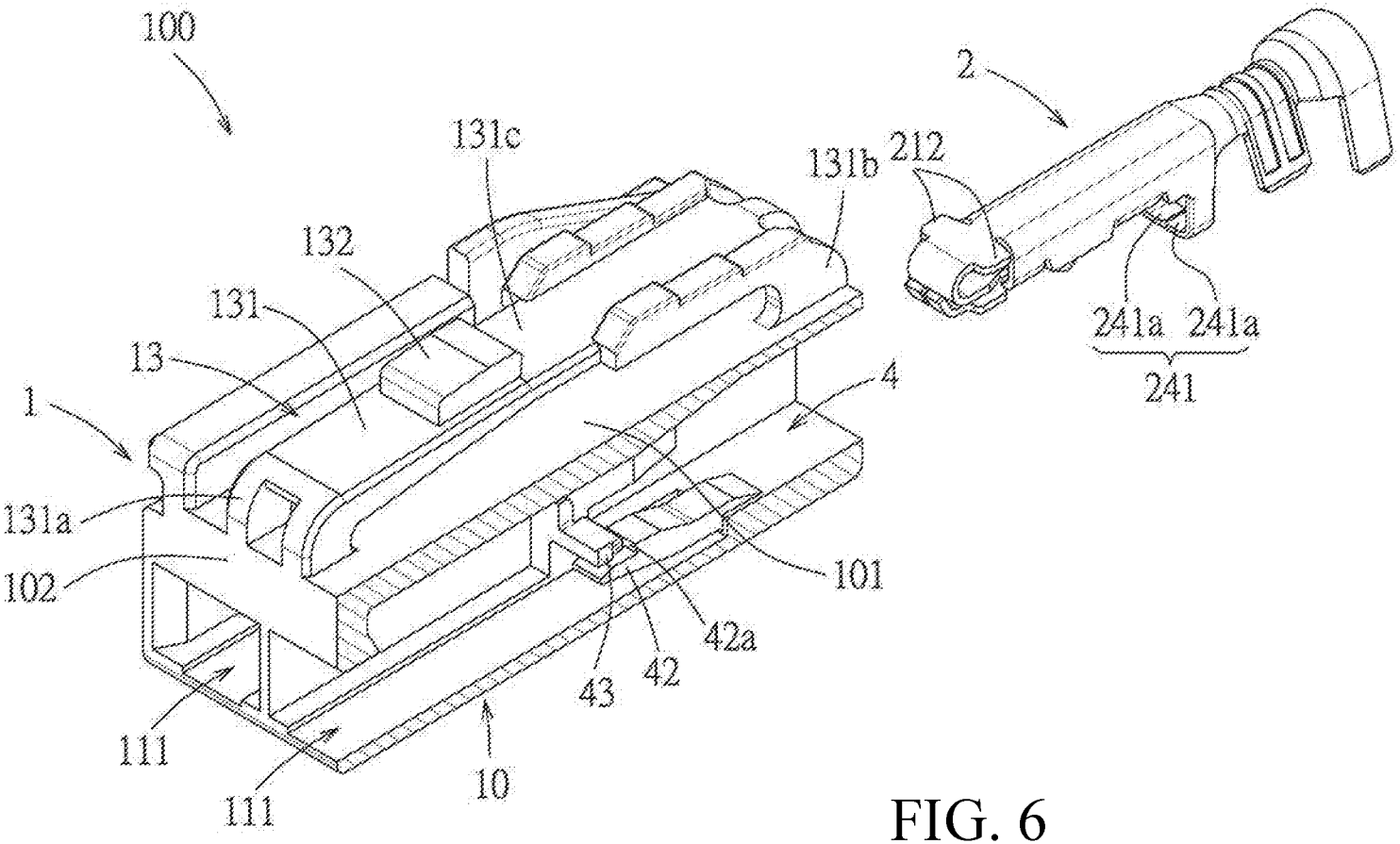
FIG. 6 is a view of FIG. 5 viewed from another angle.
Figure 7:
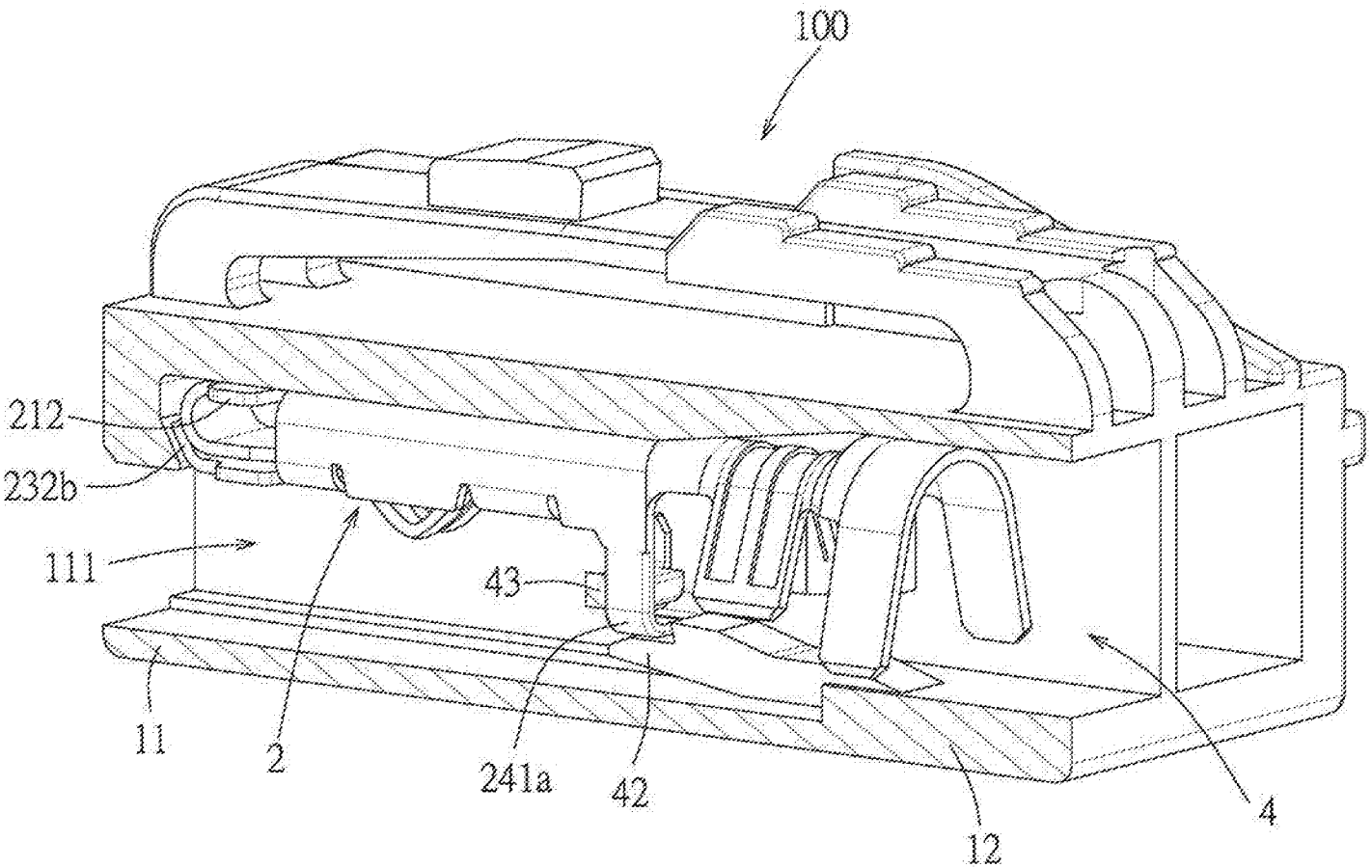
FIG. 7 is a perspective view partially sectioned and illustrating that the conductive terminal of the first connector of the embodiment is provided in the terminal groove.
Figure 8:
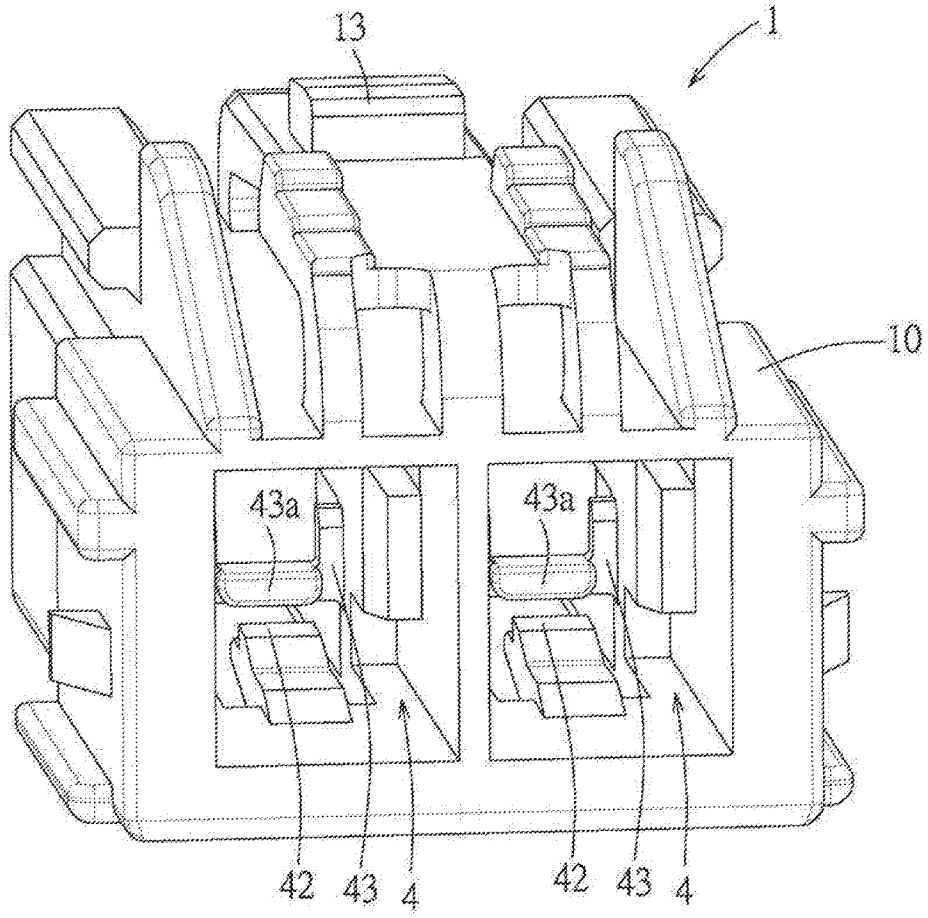
FIG. 8 is a perspective view illustrating a structure of the terminal groove of the first connector of the embodiment.
Figure 9:
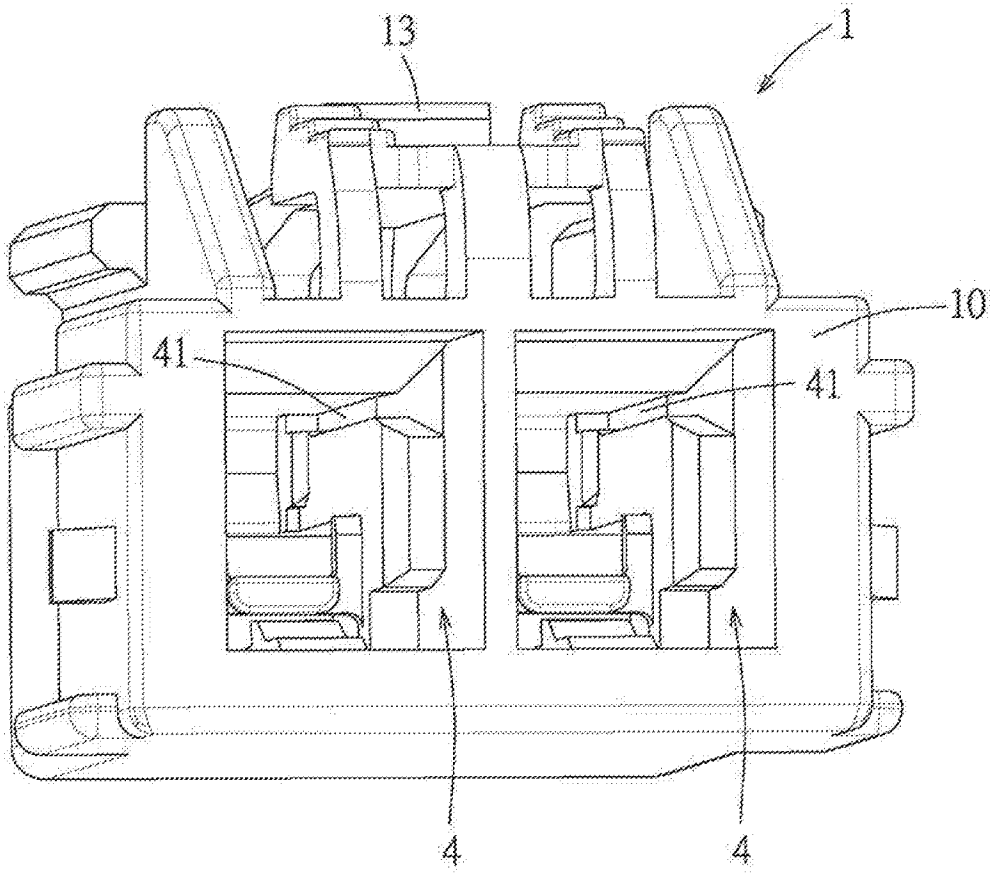
FIG. 9 is a view FIG. 8 viewed from another angle and illustrating a side groove portion in the terminal groove of the first connector of the embodiment.

Referring to FIG. 5, FIG. 6 and FIG. 7, the first insulating housing 1 has a main body 10 and a locking portion 13. The main body 10 has a top wall 101, a first mating portion 11, a first mounting portion 12 integrally connected with the first mating portion 11, a plurality of terminal grooves 4 each penetrating the first mating portion 11 and the first mounting portion 12, a plurality of first insertion slots 111 each formed in the first mating portion 11 and communicated with the plurality of terminal grooves 4. The top wall 101 has a front side edge 102 positioned at the first mating portion 11 and a rear side edge 103 positioned at the first mounting portion 12. The plurality of terminal grooves 4 respectively receive the plurality of conductive terminals 2. In combination with referring to FIG. 8 and FIG. 9, each terminal groove 4 is provided with two side groove portions 41, an elastic finger portion 42 and a stopping block 43 therein. The two side groove portions 41 respectively receive the two wing portions 212 of the corresponding conductive terminal 2, the elastic finger portion 42 is formed with a step portion 42*a* facing the front (see FIG. 6), the stopping block 43 is positioned in front of the step portion 42*a*, is spaced apart from the step portion 42*a* and is formed with a stopping protrusion 43*a* facing the rear (see FIG. 5). And the positioning portion 241 of each conductive terminal 2 forms an annular shape and has two piece bodies 241*a* facing each other, spaced apart from each other and higher than the two contact plates 232, and two front edges of the two piece bodies 241*a* abut against a rear end surface of the stopping block 43, two rear edges of the two piece bodies 241*a* abut against the step portion 42*a* of the elastic finger portion 42, so that the positioning portion 241 is positioned between the elastic finger portion 42 and the stopping block 43 and in turn the conductive terminal 2 is positioned in the terminal groove 4. Furthermore, as shown in FIG. 5 and FIG. 8, the two piece bodies 241*a* cooperate with each other to form a U-shape structure, so as to allow the two piece bodies 241*a* of the positioning portion 241 to sheath onto the stopping protrusion 43*a* by that the stopping protrusion 43*a* is inserted into an inside space surrounded by the two piece bodies 241*a* of the positioning portion 241, in turn allow the two piece bodies 241*a* to be limited between the elastic finger portion 42 and the stopping block 43. Moreover, as shown FIG. 10, when the conductive terminal 2 is inserted into the terminal groove 4, because the two guide portions 232*b* substantially cover the two connecting portions 222 respectively, it may prevent the two connecting portions 222 from directly hitting an inside wall surface of the first mating portion 11 during assembling.

Figure 10:
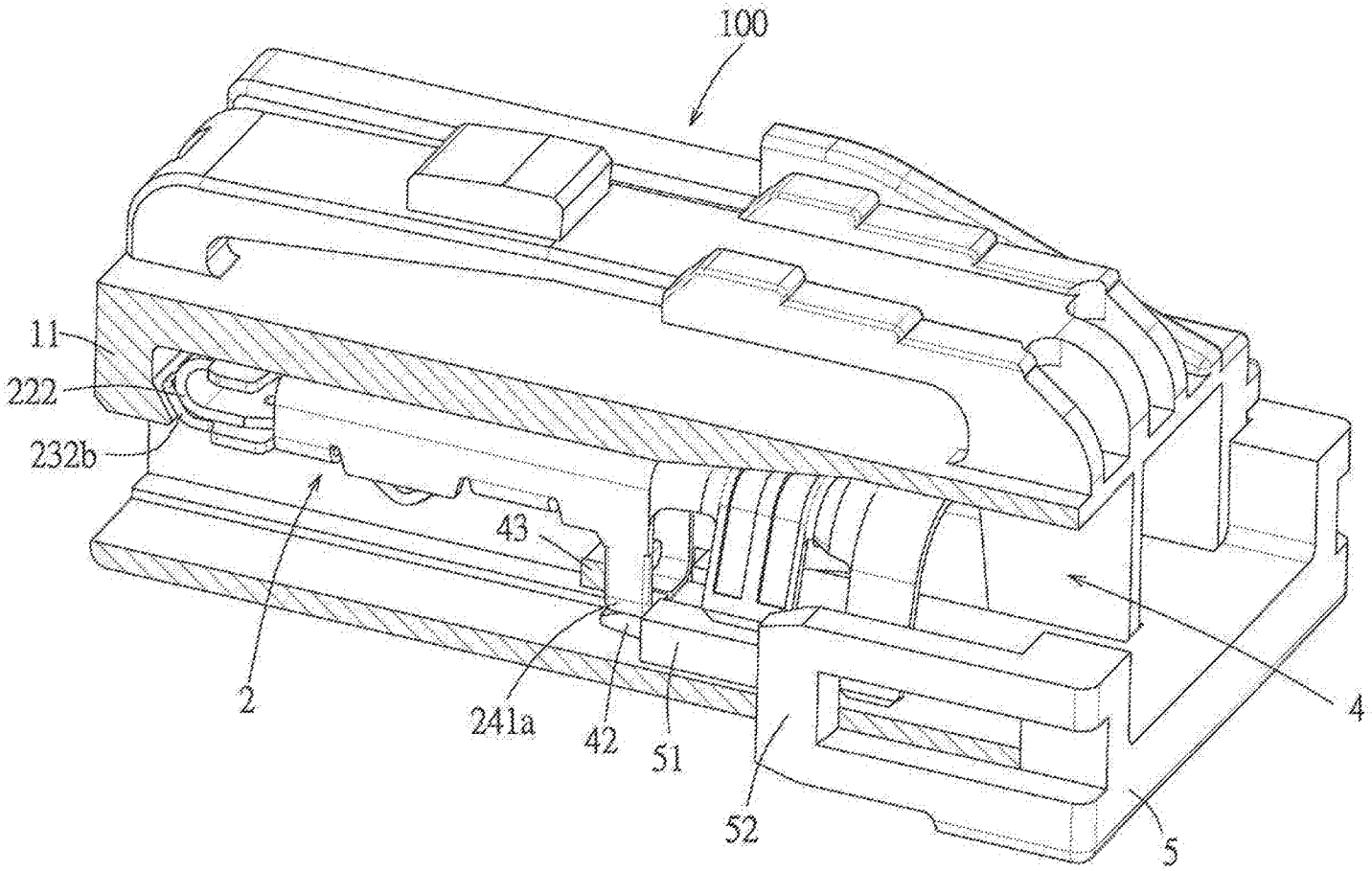
FIG. 10 is a perspective view partially sectioned and illustrating that the conductive terminal of the first connector of the embodiment is provided in the terminal groove and illustrating a functional relationship among the terminal groove, the conductive terminal and a first terminal holding member.
Figure 11:
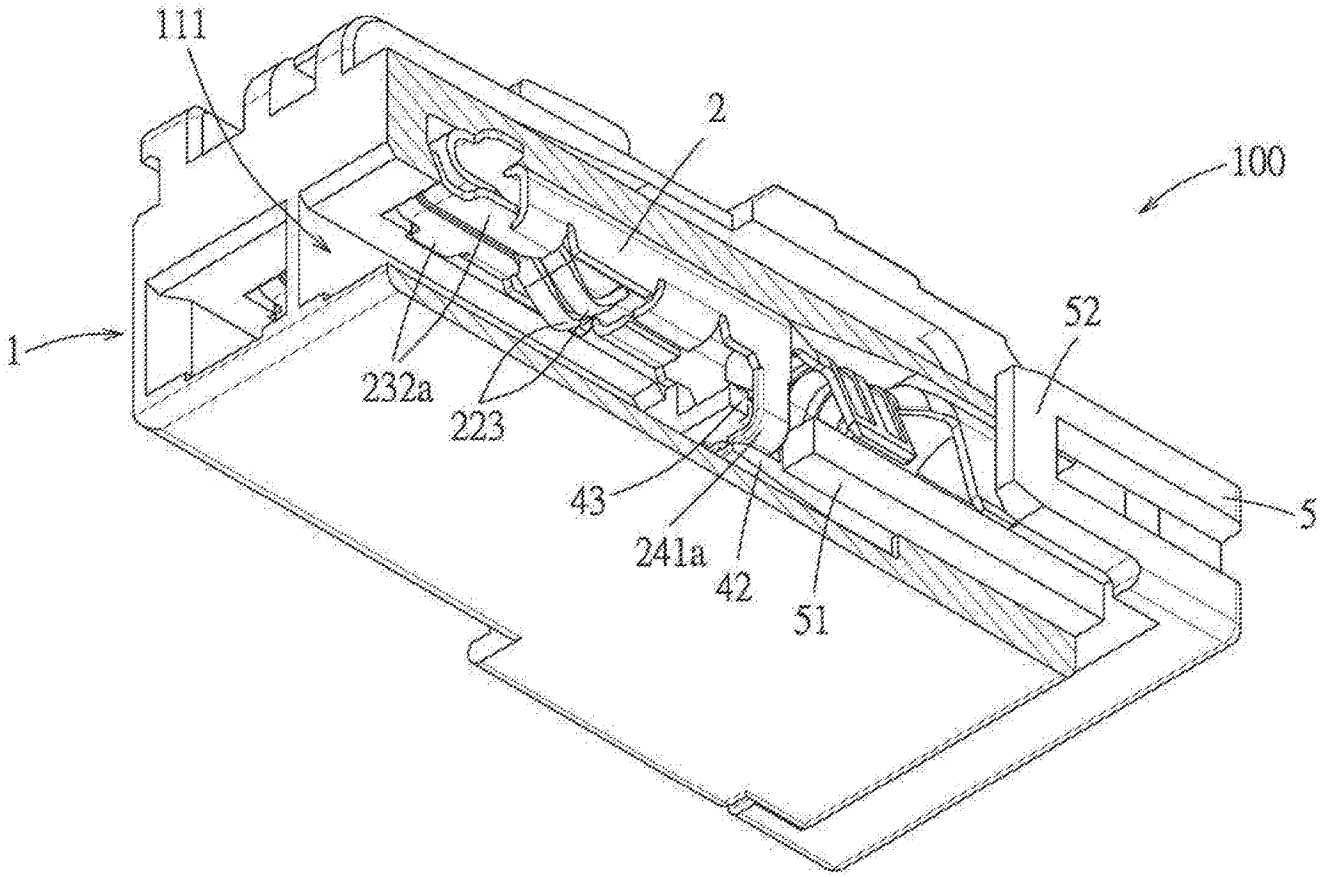
FIG. 11 is a view of FIG. 10 viewed from another angle.

Referring to FIG. 10 and FIG. 11, the first terminal holding member 5 is engaged with the first mounting portion 12 (see FIG. 1 and FIG. 3) and has a plurality of positioning pieces 51 respectively entering into the plurality of terminal groove 4, a front end of each positioning piece 51 is formed with a recessed groove 511, when the first terminal holding member 5 is assembled to the first mounting portion 12, the recessed groove 511 of each positioning piece 51 can allow each positioning piece 51 to avoid the elastic finger portion 42 in the corresponding terminal groove 4, and a front end of the positioning piece 51 is positioned on two rear ends of the two piece bodies 241*a* of the positioning portion 241 of the corresponding conductive terminal 2, so that the positioning piece 51 and the corresponding stopping block 43 cooperatively interpose and position the two piece bodies 241*a* of the conductive terminal 2, in turn fixation of the conductive terminal 2 is strengthened. Referring to FIG. 1 to FIG. 3, specifically, the first terminal holding member 5 further has two elastic latch frames 52 respectively positioned at two sides of the plurality of positioning pieces 51 and face each other. The first insulating housing 1 further has two first positioning blocks 15 respectively corresponding to the two elastic latch frames 52 and each having a wedge-shape. Before the first terminal holding member 5 is assembled to the first insulating housing 1, an oblique surface 151 of the first positioning block 15 faces the corresponding elastic latch frame 52, so that when the elastic latch frame 52 is assembled to the first insulating housing 1, the elastic latch frame 52 easily slides over and passes through the first positioning block 15, when the elastic latch frame 52 reaches a preset position, the first positioning block 15 enters into the elastic latch frame 52, an upright surface 152 of the first positioning block 15 stops the elastic latch frame 52 to reversely move, so as to allow the first terminal holding member 5 to be engaged with and fixed to the first insulating housing 1. Referring to FIG. 11, when the conductive terminal 2 is provided in the first insulating housing 1, the first contact portion 223 protrudes into the corresponding first insertion slot 111 and the second contact portion 232*a* is exposed to the corresponding first insertion slot 111.

Figure 12:
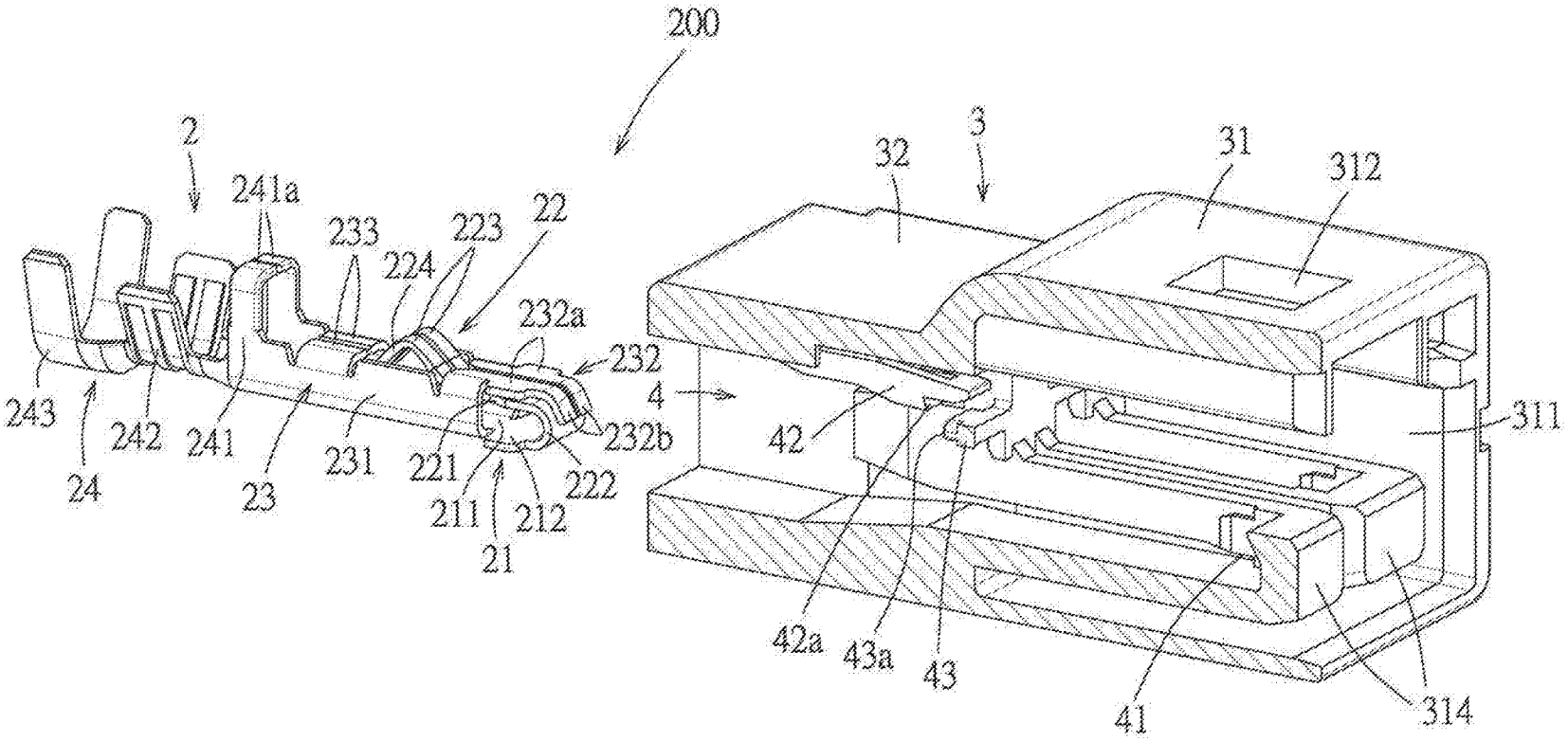
FIG. 12 is an exploded perspective view partially sectioned and illustrating a corresponding relationship between a terminal groove and a conductive terminal of the second connector of the embodiment in structure.
Figure 13:
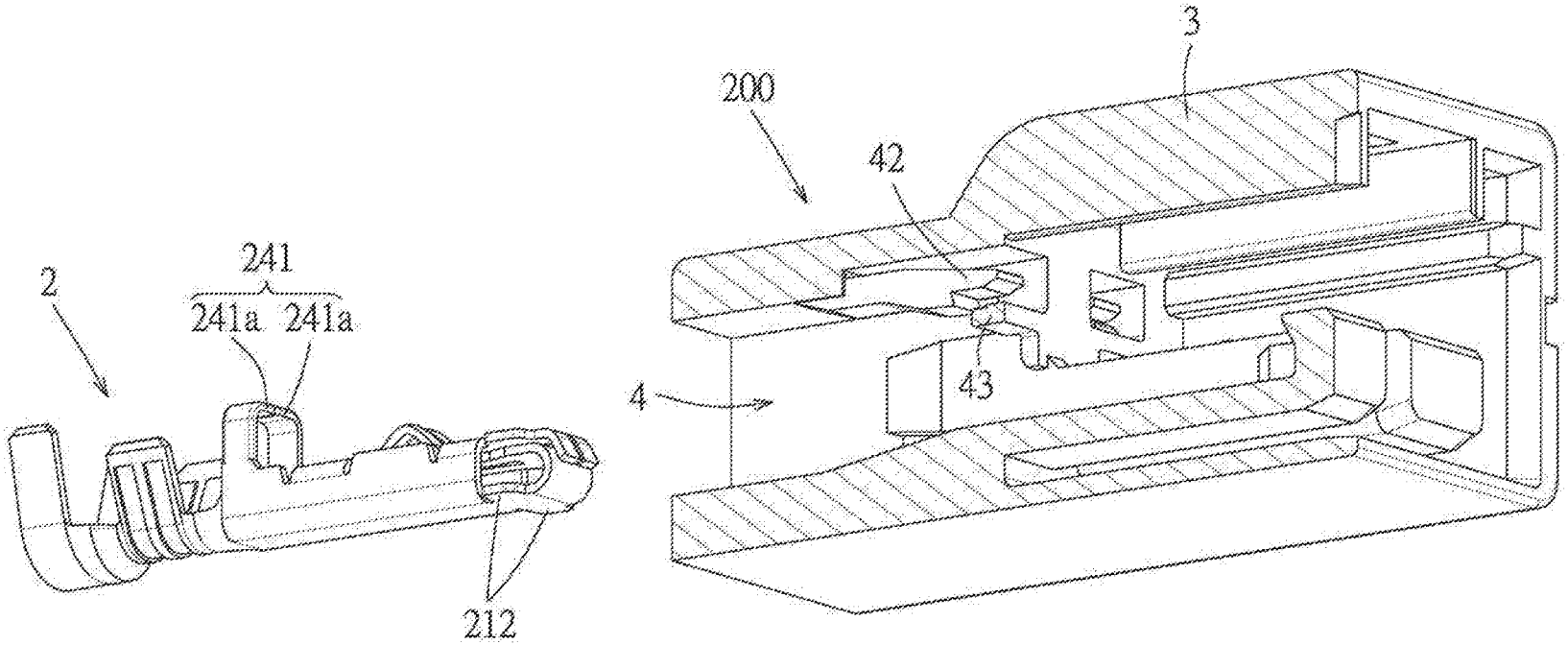
FIG. 13 is a view of FIG. 12 viewed from another angle.
Figure 14:
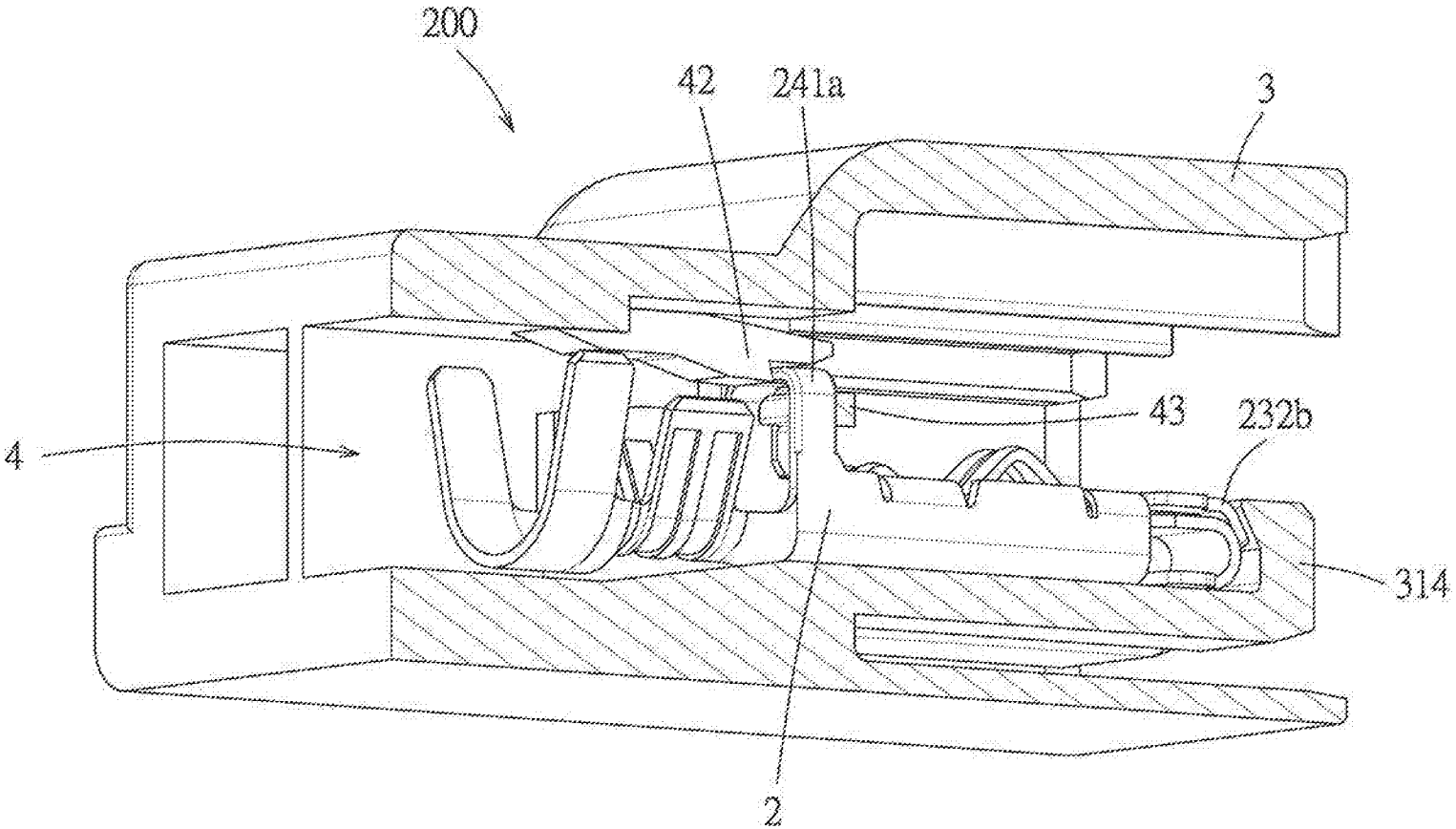
FIG. 14 is a perspective view partially sectioned and illustrating the conductive terminal is provided in the terminal groove in the second connector of the embodiment.
Figure 15:
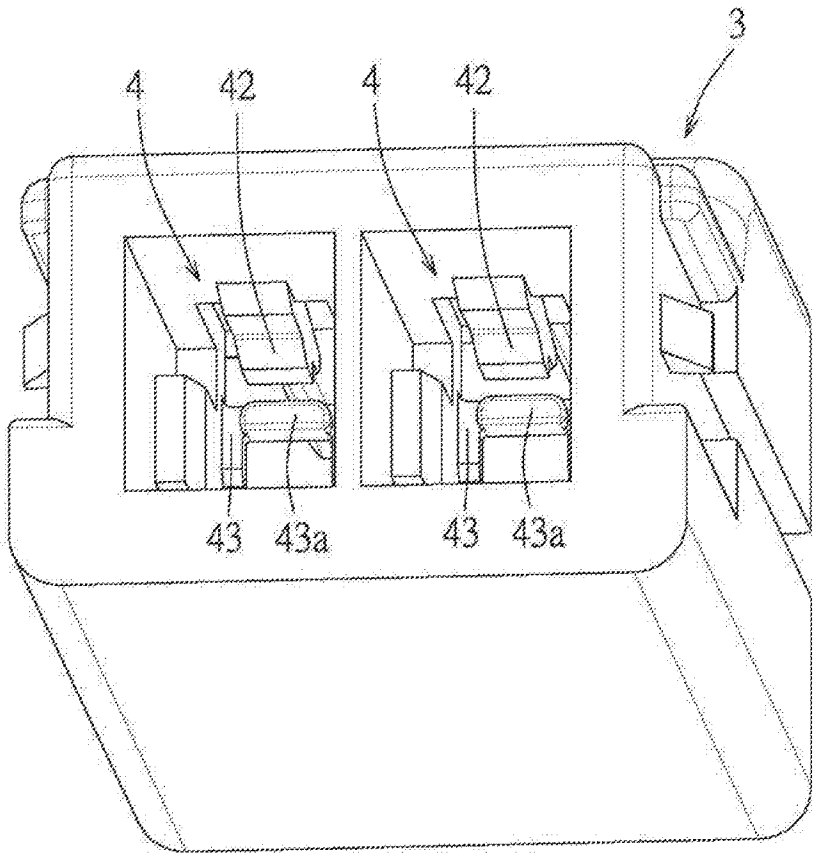
FIG. 15 is a perspective view illustrating a structure of the terminal groove of the second connector of the embodiment.
Figure 16:
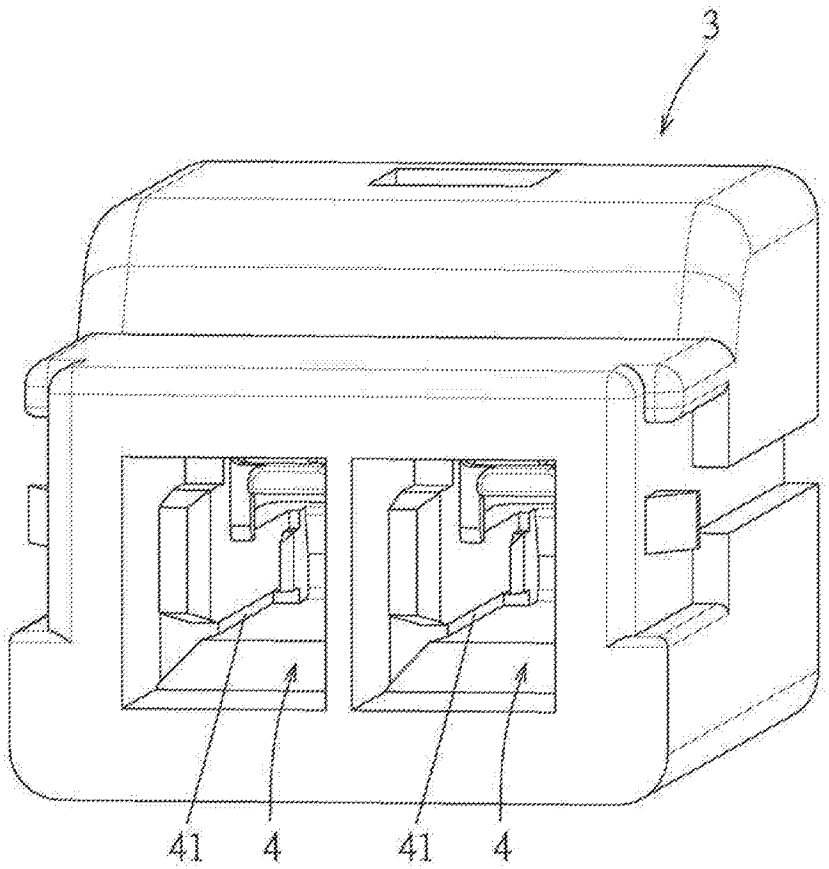
FIG. 16 is a view of FIG. 15 viewed from another angle and illustrating a side groove portion in the terminal groove of the second connector of the embodiment.
Figure 17:
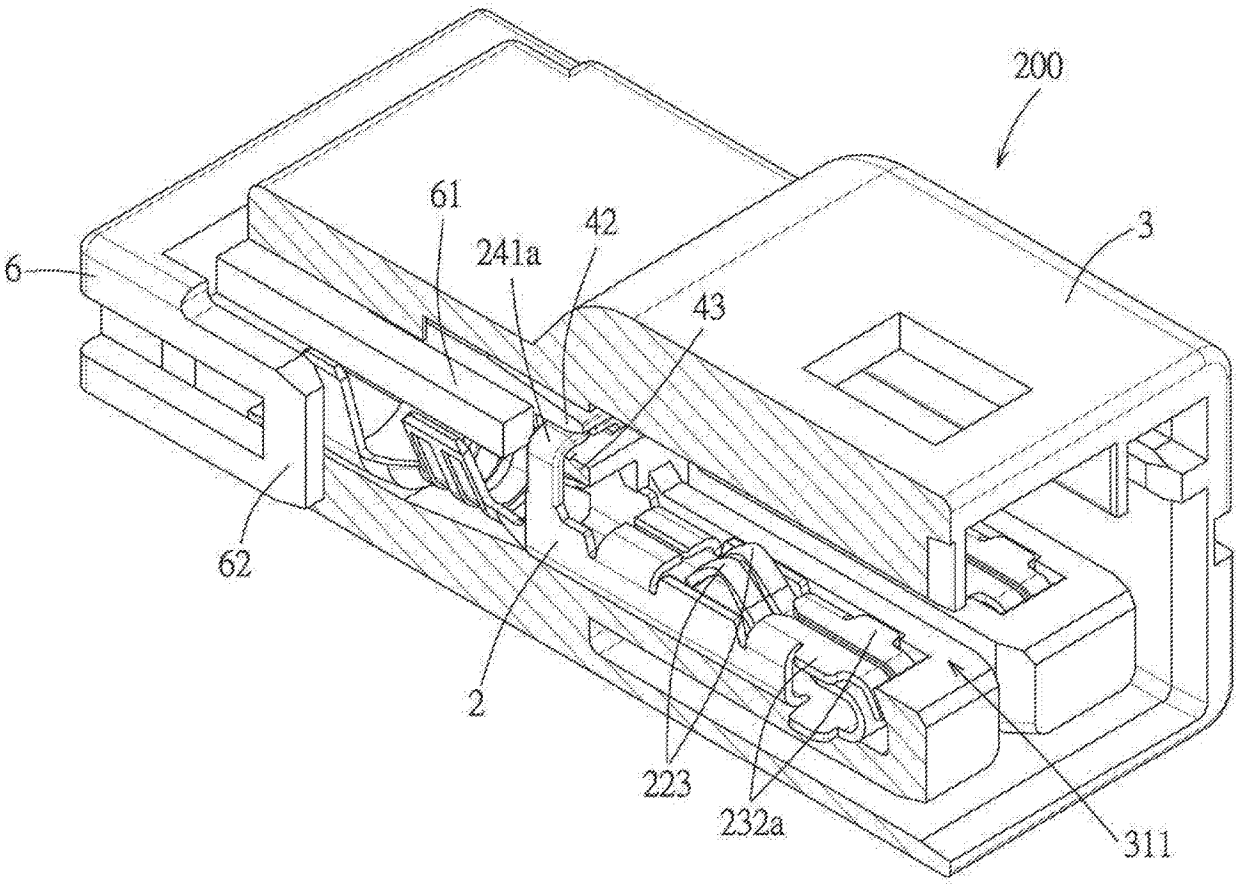
FIG. 17 is a perspective view partially sectioned and illustrating the conductive terminal is provided in the terminal groove in the second connector of the embodiment and illustrating a functional relationship among the terminal groove, the conductive terminal and a second terminal holding member.
Figure 18:
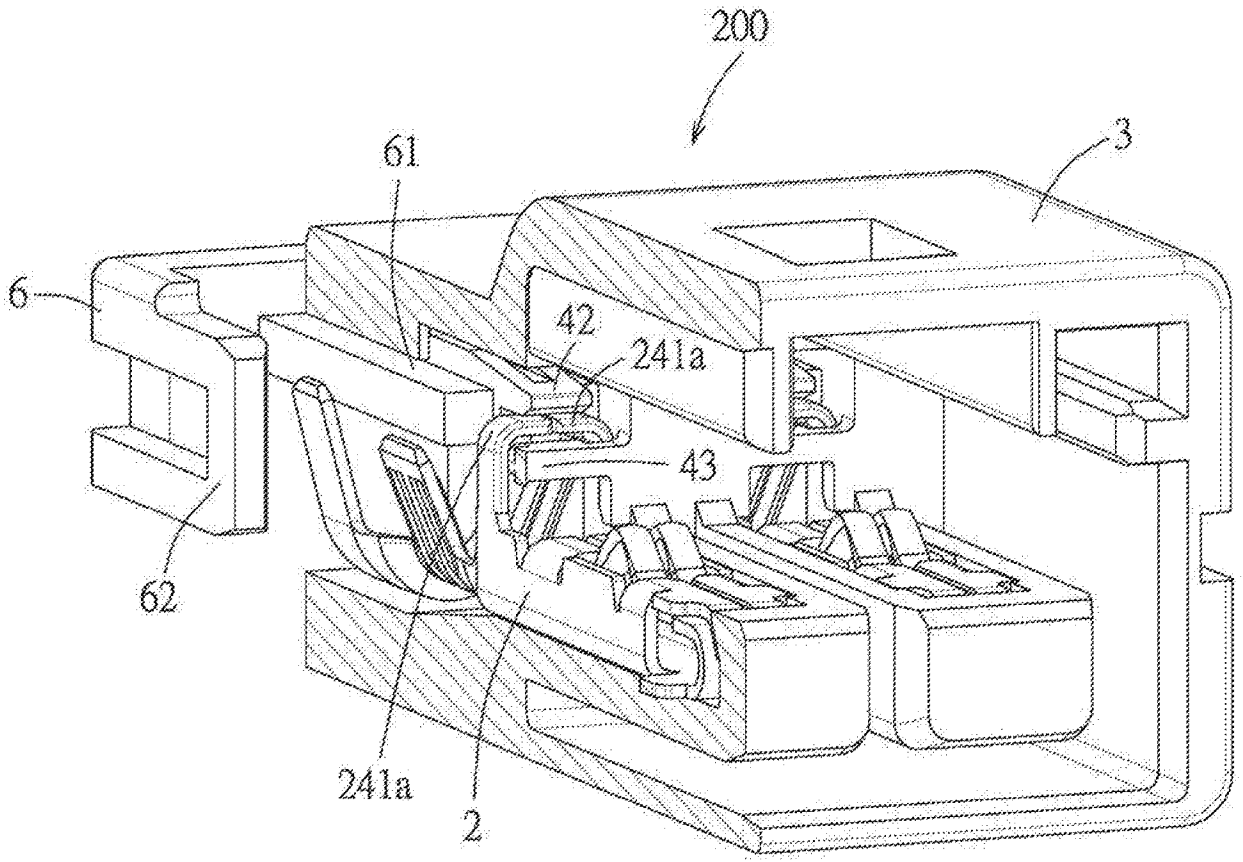
FIG. 18 is a view of FIG. 17 viewed from another angle.
Figure 19:
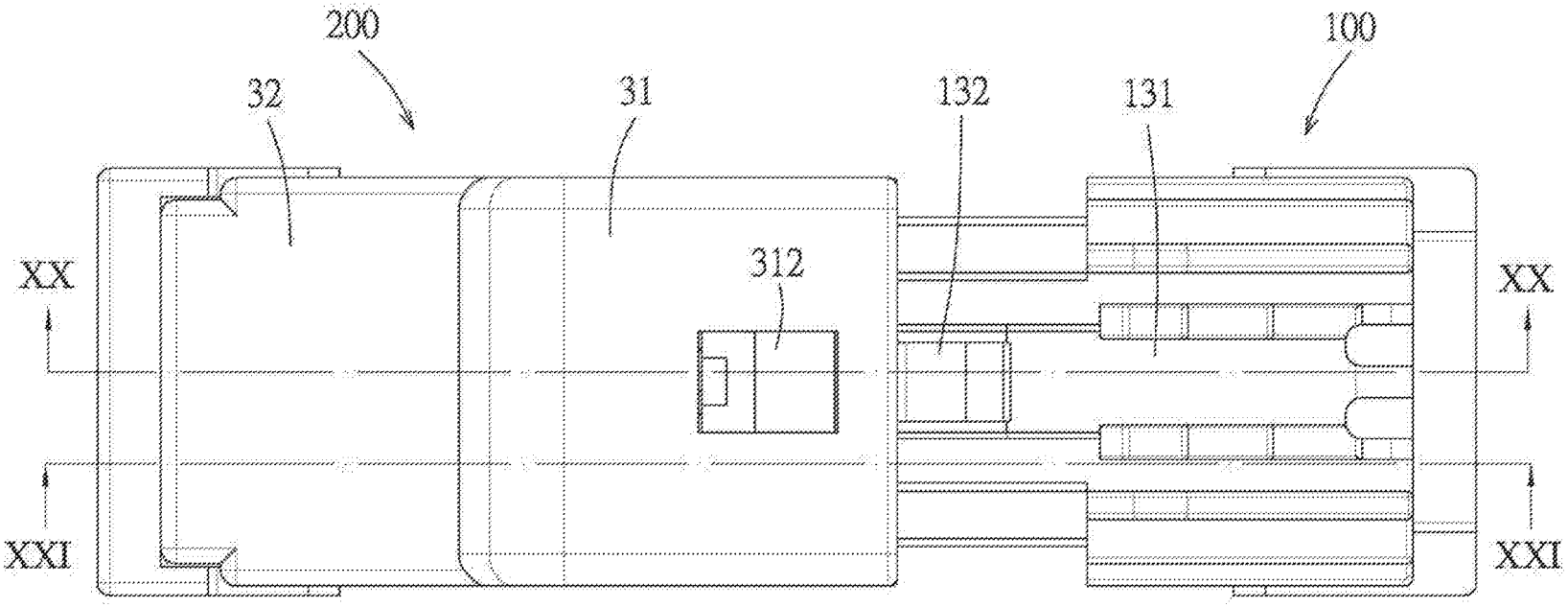
FIG. 19 is a top view illustrating a status that a latching block does not enter into an insertion slot when the first connector and the second connector of the embodiment are mated with each other.
Figure 20:
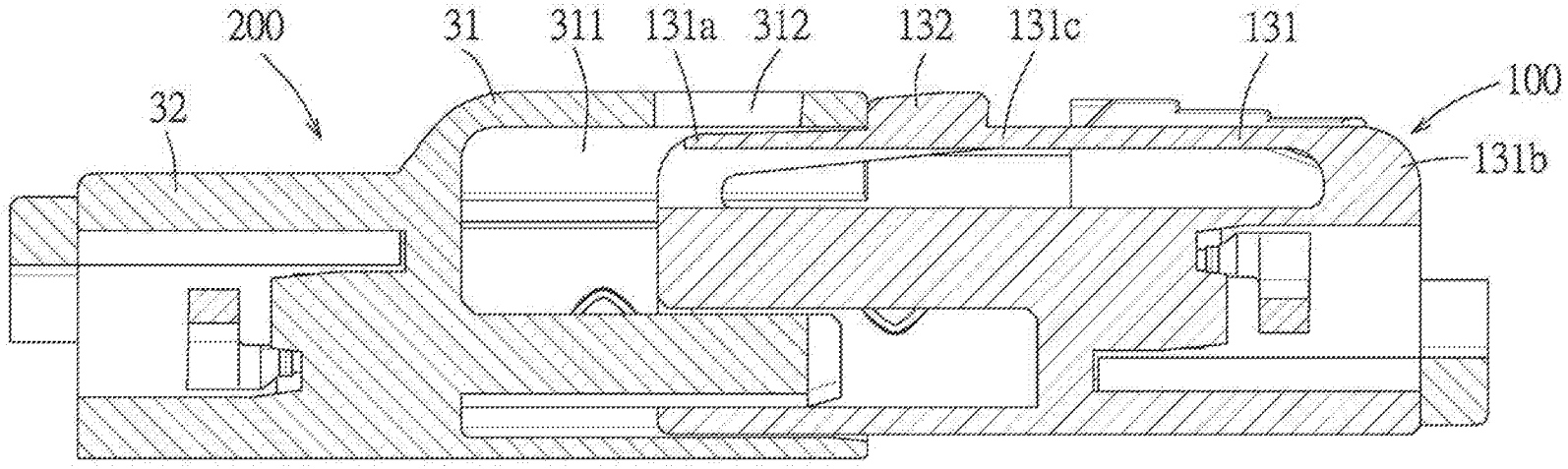
FIG. 20 is a cross sectional view taken along a line XX-XX of FIG. 19.
Figure 21:
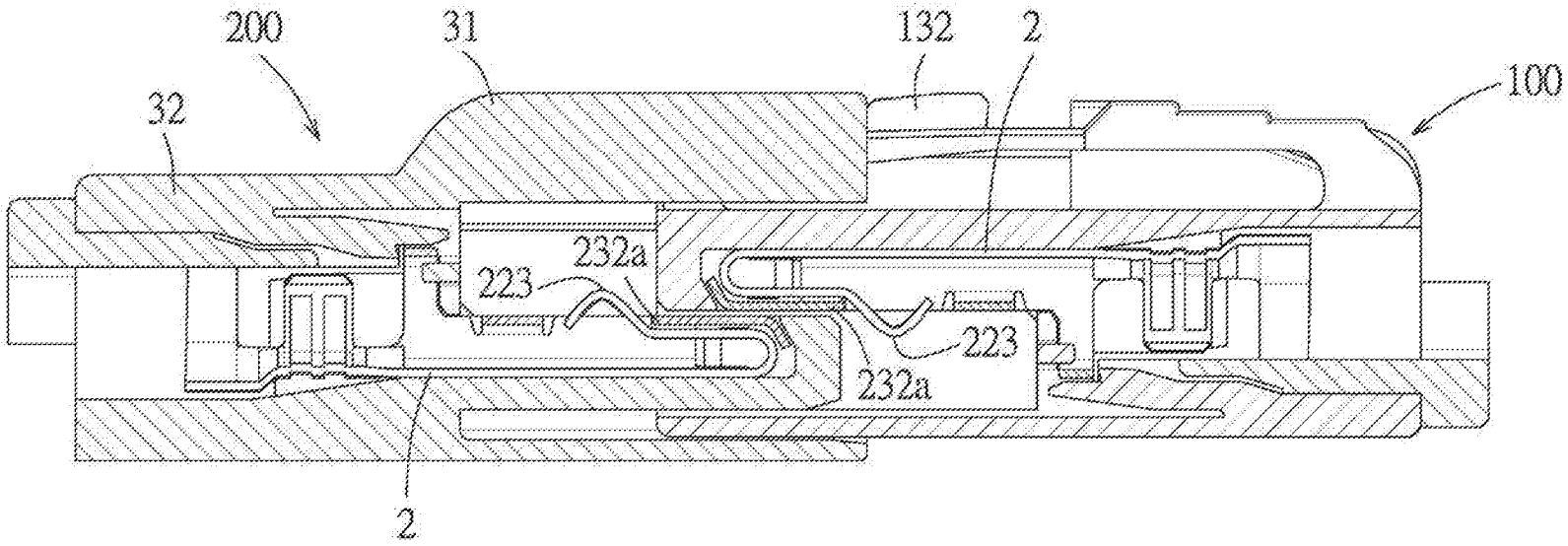
FIG. 21 is a cross sectional view taken along a line XXI-XXI of FIG. 19.

Referring to FIG. 12, FIG. 13 and FIG. 14, the second insulating housing 3 has a second mating portion 31, a second mounting portion 32 integrally connected with the second mating portion 31, and a plurality of terminal grooves 4. The second mating portion 31 is used to mate with the first mating portion 11, and has a second insertion slot 311 and a plurality of protruding blocks 314 each protruding into the second insertion slot 311, the plurality of protruding blocks 314 are respectively received in the plurality of first insertion slots 111. The plurality of terminal grooves 4 of the second insulating housing 3 each extend from the second mounting portion 32 to the corresponding protruding block 314 and are communicated with the second insertion slot 311. In combination with referring to FIG. 15 and FIG. 16, a structure inside the terminal groove 4 of the second insulating housing 3 is substantially identical to the structure inside the terminal groove 4 of the first insulating housing 1, and provision of the conductive terminal 2 of the second connector 200 in the terminal groove 4 of the second insulating housing 3 is also identical to the provision of the conductive terminal 2 of the first connector 100 in the terminal groove 4 of the first insulating housing 1, only difference lies in that the conductive terminal 2 of the second connector 200 is rotated by 180 degrees relative to the conductive terminal 2 of the first connector 100, so that the conductive terminal 2 of the first connector 100 and the conductive terminal 2 of the second connector 200 can be mated with each other, accordingly, the structure inside the terminal groove 4 of the second insulating housing 3 is rotated by 180 degrees relative to the structure inside the terminal groove 4 of the first insulating housing 1, therefore detailed description on the structure inside the terminal groove 4 of the second insulating housing 3 is omitted. Referring to FIG. 17 and FIG. 18, when each conductive terminal 2 is provided in the second insulating housing 3, the first contact portion 223 protrudes into the corresponding second insertion slot 311 and the second contact portion 232*a* is exposed to the corresponding second insertion slot 311. Similarly, the second connector 200 further comprises a second terminal holding member 6, the second terminal holding member 6 is engaged with the second mounting portion 32 and has a plurality of positioning pieces 61 respectively entering into the plurality of terminal grooves 4, a front end of each positioning piece 61 is formed with a recessed groove 611, when the second terminal holding member 6 is assembled to the second mounting portion 32, the recessed groove 611 of each positioning piece 61 can allow each positioning piece 61 to avoid the elastic finger portion 42 in the corresponding terminal groove 4, and a front end of the positioning piece 61 abuts against two rear ends of the two piece bodies 241*a* of the corresponding conductive terminal 2, so that the positioning piece 61 and the stopping block 43 in the corresponding terminal groove 4 cooperatively interpose and position the two piece bodies 241*a* of the conductive terminal 2. Moreover, Referring to FIG. 1 to FIG. 3, the second terminal holding member 6 further has two elastic latch frames 62 respectively positioned at two sides of the plurality of positioning pieces 61 and face each other. The second insulating housing 3 further has two second positioning blocks 33 respectively corresponding to the two elastic latch frames 62 and each having a wedge-shape. A manner of the second terminal holding member 6 assembled to the second insulating housing 3 is identical to the manner of the first terminal holding member 5 assembled to the first insulating housing 1, so detail description is omitted.

Figure 25:
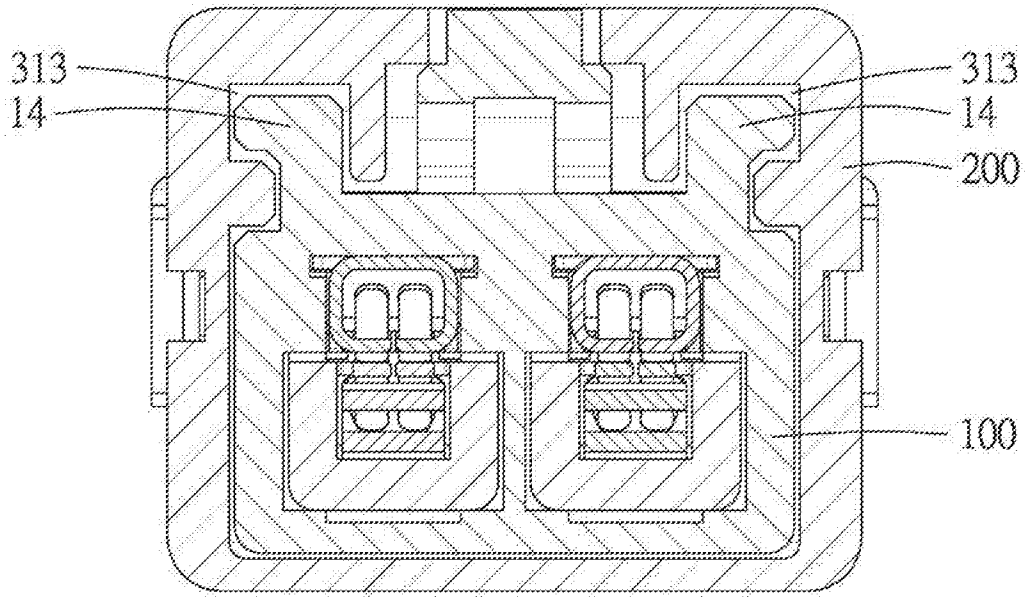
FIG. 25 is a cross sectional view taken along a line XXV-XXV of FIG. 22 and illustrating a functional relationship between a key of the first connector and a key groove of the second connector in the embodiment.

Referring to FIG. 5 and FIG. 6, the locking portion 13 of the first insulating housing 1 has an elastic support member 131 which extends along the front-rear direction and is integrally connected to the top wall 101 and a latching block 132. The elastic support member 131 has a first connecting section 131*a* connected to the top wall 101 and adjacent to the front side edge 102, a second connecting section 131*b* connected to the top wall 101 and adjacent to the rear side edge 103, and an elastic section 131*c* positioned between the first connecting section 131*a* and the second connecting section 131*b* and spaced apart from the top wall 101. By that the first connecting section 131*a* and the second connecting section 131*b* respectively positioned at two ends of the elastic support member 131 are respectively connected to the top wall 101 of the main body 10, that is the elastic support member 131 is closed at the two ends, so that the elastic support member 131 is not easily broken due to pulling. The latching block 132 is provided on the elastic section 131*c*. In combination with referring to FIG. 12, the second insertion slot 311 of the second insulating housing 3 receives the first mating portion 11 and a part of the locking portion 13, and the second mating portion 31 further has a latching groove 312 receiving the latching block 132, the latching groove 312 is communicated with the second insertion slot 311. Moreover, in combination with referring to FIG. 1 and FIG. 25, the first insulating housing 1 further has two keys 14 respectively positioned at two sides of the locking portion 13 and parallel to the front-rear direction, the two keys 14 are respectively connected to the top wall 101 and each extend rearwardly from the front side edge 102 along the front-rear direction. The second mating portion 31 of the second insulating housing 3 further has two key grooves 313 respectively receiving the two keys 14, and the two keys grooves 313 are communicated with the second insertion slot 311. That the two keys 14 are respectively engaged with the two key grooves 313 may prevent the first mating portion 11 of the first connector 100 from being improperly inserted into the second insertion slot 311 of the second connector 200. Moreover, the two keys 14 may have different cross sectional profiles, the cross sectional profiles of the two keys 14 may be adjusted and the corresponding key grooves 313 may be also correspondingly adjusted, so that different electrical connector assemblies each have the keys 14 and the key grooves 313 which have different cross sectional profiles, and thus it may prevent different electrical connector assemblies from being improperly assembled therebetween with respect to a system having a plurality of electrical connector assemblies.

Referring to FIG. 19, FIG. 20, FIG. 21 and FIG. 25, during mating of the first connector 100 and the second connector 200, only the two keys 14 of the first connector 100 respectively correspond to the two keys grooves 313 of the second connector 200 in position and profile, can the first mating portion 11 enter into the second insertion slot 311; then, the latching block 132 of the first connector 100 is pressed down so as to enter into the second insertion slot 311, the latching block 132 is allowed to slide relative to the second insulating housing 3 and in turn move and enter into the latching groove 312, so that locking between the first connector 100 and the second connector 200 is completed. It should be specifically noted that, in combination with referring to FIG. 10 and FIG. 14, during the mating of the first connector 100 and the second connector 200, taking the first connector 100 as an example, because two front ends of the two second contact portions 232*a* of each conductive terminal 2 are spaced apart from the inside wall surface of the first mating portion 11 by a certain distance, however, the two guide portions 232*b* are respectively bent forwardly and obliquely from the two second contact portions 232*a*, and so does the second connector 200 in structure, therefore every two mated conductive terminal 2 can slide along the guide portions 232*b* and cannot be blocked during assembling.

Figure 22:
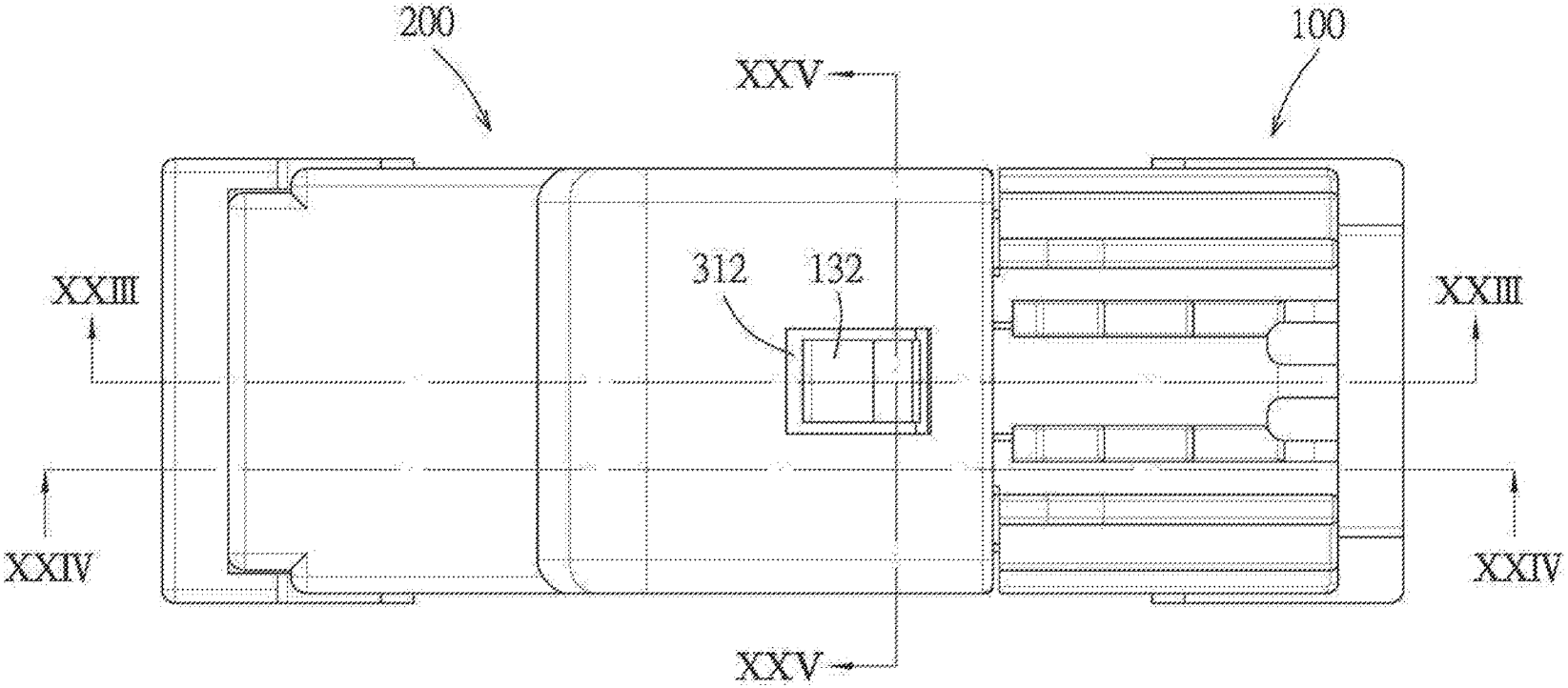
FIG. 22 is a top view illustrating a status that the first connector and the second connector of the embodiment have been mated with each other.
Figure 23:
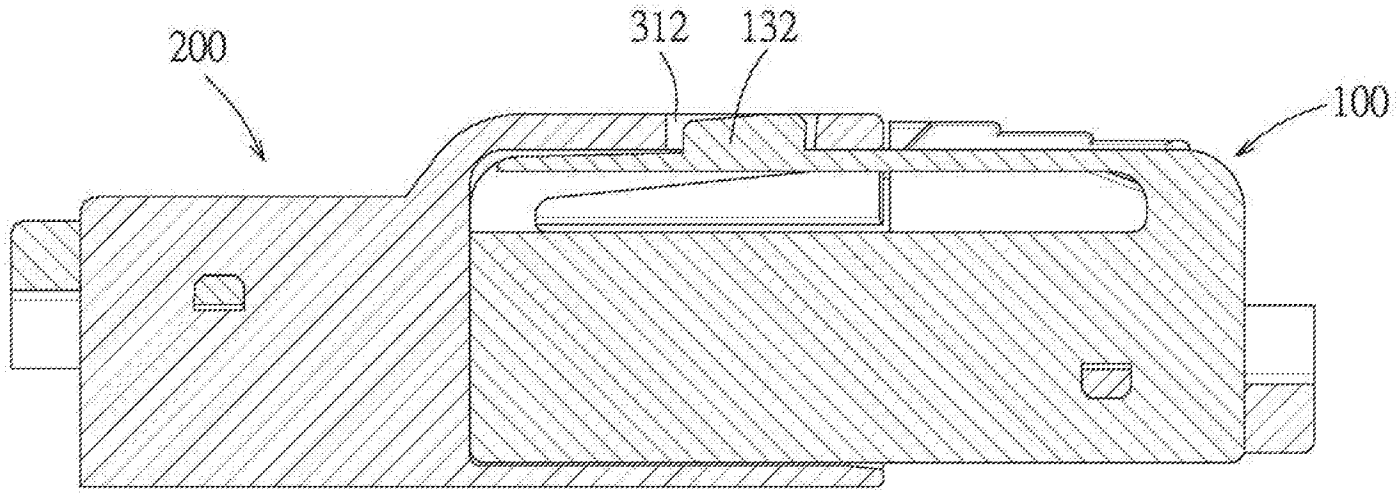
FIG. 23 is a cross sectional view taken along a line XXIII-XXIII of FIG. 22 and illustrating that the latching block has been positioned in a latching groove in the embodiment.
Figure 24:
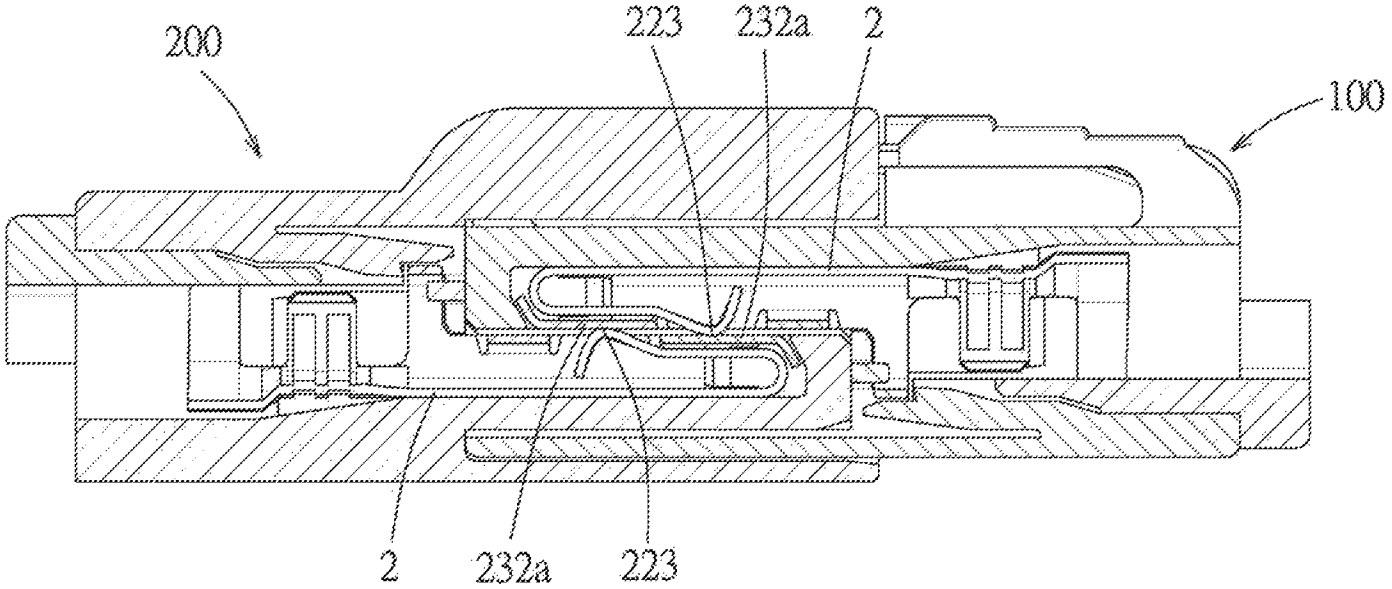
FIG. 24 is a cross sectional view taken along a line XXIV-XXIV of FIG. 22 and illustrating that the conductive terminal of the first connector and the conductive terminal of the second connector have been mated with each other to form four contacting regions in the embodiment.

Referring to FIG. 22, FIG. 23 and FIG. 24, when the mating between the first connector 100 and the second connector 200 has been completed, the latching block 132 of the first connector 100 has been positioned in the latching groove 312 of the second connector 200, that the latching block 132 is latched in the latching groove 312 prevents the first connector 100 from being withdrawn, and in turn allows the first connector 100 and the second connector 200 to be fixed relative to each other and be stably connected with each other. Moreover, as shown in FIG. 24, in every two mated conductive terminal 2 between the first connector 100 and the second connector 200, the two first contact portions 223 of one conductive terminal 2 respectively contact the two second contact portions 232*a* of the other conductive terminal 2 and the two first contact portions 223 of the other conductive terminal 2 respectively contact the two second contact portions 232*a* of the one conductive terminal 2, so that four contacting regions are formed between every two mated conductive terminals 2, which provides a more stable and more reliable electrical connection and can promote performance and stability under long-term use.

Because the conductive terminal 2 of the first connector 100 and the conductive terminal 2 of the second connector 200 are identical in structure and dimension, the conductive terminal 2 of the first connector 100 and the conductive terminal 2 of the second connector 200 may be manufactured with the same mold, not only manufacturing cost may be saved, but also the number and inventory of the components can be reduced.

In conclusion, the conductive terminal 2 of the first connector 100 and the conductive terminal 2 of the second connector 200 are identical in structure and dimension, manufacturing cost may be saved; in every two mated conductive terminal 2, the two first contact portions 223 of one conductive terminal 2 respectively contact the two second contact portions 232*a* of the other conductive terminal 2 and the two first contact portions 223 of the other conductive terminal 2 respectively contact the two second contact portions 232*a* of the one conductive terminal 2, so that four contacting regions are formed between every two mated conductive terminals 2, which provides a more stable and more reliable electrical connection and can promote performance and stability under long-term use; the structural design of the conductive terminal 2 may prevent hooking and entangling between one conductive terminal 2 and another conductive terminal 2 or between the conductive terminal 2 and the cable 7 during manufacturing, and in turn prevent the conductive terminal 2 from being damaged; and, that the two keys 14 are respectively engaged with the two keys grooves 313 may prevent the first connector 100 and the second connector 200 from being improperly inserted. Therefore, the object of the present disclosure is definitely attained.

The above described are only the embodiments, which cannot limit the scope of the implementation of the present disclosure, namely simple equivalent variations and modifications made according to the scope of the claims and content of the present disclosure are still fallen within the scope of the present disclosure.

The invention claimed is:

1. A conductive terminal, comprising:

a base unit comprising a bottom plate extending along a front-rear direction and two side plates integrally extending upwardly from a left side and a right side of the bottom plate respectively;

two elastic contact pieces arranged side by side, each elastic contact piece comprising a connecting portion bent upwardly from a front end of the bottom plate, an arm portion extending rearwardly from the connecting portion, positioned above the bottom plate and spaced apart from the bottom plate, and a first contact portion positioned at a rear end of the arm portion;

a tail unit connected to a rear end of the bottom plate; and two contact plates respectively bent from two upper edges of two front ends of the two side plates toward each other, each contact plate having a second contact portion and a guide portion positioned in front of the second contact portion, the second contact portion being positioned above the arm portion of the corresponding the elastic contact piece, the guide portion extending forwardly and downwardly and being positioned above the connecting portion, the two first contact portions of the two elastic contact pieces extending upwardly respectively from two rear ends of the two contact plates and being respectively higher than the two second contact portions.

2. The conductive terminal according to claim 1, wherein the bottom plate comprises a plate portion and two wing portions respectively extending from two sides of a front end of the plate portion toward two opposite directions, and the two wing portions respectively are positioned in front of the two side plates.

3. The conductive terminal according to claim 2, wherein the tail unit along the front-rear direction comprises a positioning portion connected to the plate portion, a conductor fixing portion connected to the positioning portion and used to clamp and fix a part of a conductor of a cable without an insulating covering and an insulating covering fixing portion connected to the conductor fixing portion and used to clamp and fix a part of the cable with the insulating covering.

4. The conductive terminal according to claim 1, wherein the two side plates of the base unit respectively at least partially cover two side gaps between two side edges of the bottom plate and two side edges of the two arm portions of the two elastic contact pieces.

5. The conductive terminal according to claim 4, wherein each elastic contact piece further comprises an extending portion, the extending portion bent from a rear end of the first contact portion and extending rearwardly and obliquely, and a distal end of the extending portion enters into between the two side plates and is not higher than two upper edges of the two side plates.

6. The conductive terminal according to claim 5, wherein the conductive terminal further comprises two protect plates respectively bent from two upper edges of two rear ends of the two side plates toward each other, the two protect plates respectively are positioned behind the two extending portions of the two elastic contact pieces.

7. An electrical connector assembly, comprising:

a first connector and a second connector mated with the first connector, the first connector comprising a first insulating housing and a plurality of conductive terminals provided in the first insulating housing, the second connector comprising a second insulating housing and a plurality of conductive terminals provided in the second insulating housing;

each conductive terminal of the first connector and the second connector having:

a base unit comprising a bottom plate extending along a front-rear direction and two side plates integrally extending upwardly from a left side and a right side of the bottom plate respectively;

two elastic contact pieces arranged side by side, each elastic contact piece having a connecting portion bent upwardly from a front end of the bottom plate, an arm portion extending rearwardly from the connecting portion, positioned above the bottom plate and spaced apart from the bottom plate, and a first contact portion positioned at a rear end of the arm portion;

a tail unit connected to a rear end of the bottom plate; and two contact plates respectively bent from two upper edges of two front ends of the two side plates toward each other, each contact plate having a second contact portion and a guide portion positioned in front of the second contact portion, the second contact portion being positioned above the arm portion of the corresponding the elastic contact piece, the guide portion extending forwardly and downwardly and being positioned above the connecting portion, the two first contact portions of the two elastic contact pieces extending upwardly respectively from two rear ends of the two contact plates and being respectively higher than the two second contact portions;

the plurality of conductive terminals of the first connector being used to respectively mate with the plurality of conductive terminals of the second connector, and in every two mated conductive terminals between the first connector and the second connector, the two first contact portions of one conductive terminal respectively contacting the two second contact portions of the other conductive terminal and the two first contact portions of the other conductive terminal respectively contacting the two second contact portions of the one conductive terminal, so that four contacting regions being formed between every two mated conductive terminals.

8. The electrical connector assembly according to claim 7, wherein in each conductive terminal, the two side plates of the base unit respectively at least partially cover two side gaps between two side edges of the bottom plate and two side edges of the two arm portions of the two elastic contact pieces.

9. The electrical connector assembly according to claim 8, wherein in each conductive terminal, each elastic contact piece further has an extending portion, the extending portion bent from a rear end of the first contact portion and extending rearwardly and obliquely, and a distal end of the extending portion enters into between the two side plates and is not higher than two upper edges of the two side plates.

10. The electrical connector assembly according to claim 9, wherein in each conductive terminal, the conductive terminal further has two protect plates respectively bent from two upper edges of two rear ends of the two side plates toward each other, the two protect plates respectively are positioned behind the two extending portions of the two elastic contact pieces.

11. The electrical connector assembly according to claim 7, wherein the first insulating housing has a first mating portion, a first mounting portion integrally connected with the first mating portion and a plurality of terminal grooves each penetrating the first mating portion and the first mounting portion;

the second insulating housing has a second mating portion, a second mounting portion integrally connected with the second mating portion and a plurality of terminal grooves each penetrating the second mating portion and the second mounting portion;

the second mating portion is used to mate with the first mating portion;

the plurality of terminal grooves of the first insulating housing respectively receive the plurality of conductive terminals of the first connector;

the plurality of terminal grooves of the second insulating housing respectively receive the plurality of conductive terminals of the second connector.

12. The electrical connector assembly according to claim 11, wherein in each conductive terminal, the bottom plate has a plate portion and two wing portions respectively extending from two sides of a front end of the plate portion toward two opposite directions, and the two wing portions respectively are positioned in front of the two side plates;

each terminal groove is provided with two side groove portions respectively seizing two wing portions of the corresponding conductive terminal therein.

13. The electrical connector assembly according to claim 11, wherein in each conductive terminal, the tail unit along the front-rear direction has a positioning portion connected to the plate portion, a conductor fixing portion connected to the positioning portion and used to clamp and fix a part of a conductor of a cable without an insulating covering and an insulating covering fixing portion connected to the conductor fixing portion and used to clamp and fix a part of the cable with the insulating covering.

14. The electrical connector assembly according to claim 13, wherein each terminal groove is further provided with an elastic finger portion and a stopping block positioned in front of the elastic finger portion and spaced apart from the elastic finger portion therein, the elastic finger portion is formed with a step portion facing the front, the stopping block is formed with a stopping protrusion facing the rear;

the positioning portion of each conductive terminal forms an annular shape and has two piece bodies facing each other, spaced apart from each other and higher than the contact plate, and two front edges of the two piece bodies abut against a rear end surface of the stopping block, two rear edges of the two piece bodies abut against the step portion of the elastic finger portion, the positioning portion is sheathed onto the stopping block, so that the positioning portion is positioned between the elastic finger portion and the stopping block and in turn the conductive terminal is positioned in the terminal groove.

15. The electrical connector assembly according to claim 14, wherein the first connector further comprises a first terminal holding member, the second connector further comprises a second terminal holding member;

the first terminal holding member is engaged with the first mounting portion and has a plurality of first positioning pieces respectively entering into the plurality of terminal grooves of the first insulating housing, a front end of each first positioning piece is positioned on two rear ends of the two piece bodies of the positioning portion of the corresponding conductive terminal of the first connector;

the second terminal holding member is engaged with the second mounting portion and has a plurality of second positioning pieces respectively entering into the plurality of terminal grooves of the second insulating housing, a front end of each second positioning piece is positioned on two rear ends of the two piece bodies of the positioning portion of the corresponding conductive terminal of the second connector.

* * * * *